US011688954B2

(12) United States Patent
Yong et al.

(10) Patent No.: US 11,688,954 B2
(45) Date of Patent: Jun. 27, 2023

(54) HIGHLY-INTEGRATED VEHICLE ANTENNA CONFIGURATION

(71) Applicant: Shanghai Amphenol Airwave Communication Electronics Co., Ltd, Shanghai (CN)

(72) Inventors: Checkchin Yong, Shanghai (CN); Hongliang Gu, Shanghai (CN); Jin Shang, Shanghai (CN)

(73) Assignee: Shanghai Amphenol Airwave Communication Electronics Co., Ltd, Shanghai (CN)

( * ) Notice: Subject to any disclaimer, the term of this patent is extended or adjusted under 35 U.S.C. 154(b) by 0 days.

(21) Appl. No.: 17/468,695

(22) Filed: Sep. 8, 2021

(65) Prior Publication Data

US 2022/0190489 A1 Jun. 16, 2022

(30) Foreign Application Priority Data

Dec. 15, 2020 (CN) ..... 202011478718.3

(51) Int. Cl.
*H01Q 21/28* (2006.01)
*H01Q 5/40* (2015.01)
*H01Q 1/32* (2006.01)

(52) U.S. Cl.
CPC ..... *H01Q 21/28* (2013.01); *H01Q 1/325* (2013.01); *H01Q 1/3208* (2013.01); *H01Q 1/3291* (2013.01); *H01Q 5/40* (2015.01)

(58) Field of Classification Search
CPC ..... H01Q 21/28; H01Q 1/3208; H01Q 1/325; H01Q 1/3291; H01Q 5/40; H01Q 1/2291;
(Continued)

(56) References Cited

U.S. PATENT DOCUMENTS 6,441,792 B1 * 8/2002 Sievenpiper ..... H01Q 15/008 343/909
10,469,136 B2 * 11/2019 Kim ..... H01Q 21/29
11,476,563 B2 * 10/2022 Ortigosa ..... H01Q 21/28

FOREIGN PATENT DOCUMENTS

CN 110462932 A * 11/2019 ..... H01Q 1/38
DE 102020206164 B3 * 9/2021 ..... H01Q 1/1271
(Continued)

*Primary Examiner* — Ab Salam Alkassim, Jr.
*Assistant Examiner* — Anh N Ho

(57) ABSTRACT

The present disclosure provides a highly-integrated vehicle antenna configuration, which includes: a metal structure as a reference ground for a broadband antenna; a broadband antenna; a first electrical connection structure electrically connected to the metal structure and the broadband antenna; a first excitation signal source loaded between the metal structure and the broadband antenna, wherein by exciting some resonance modes of the metal structure and the broadband antenna, the broadband design is realized; and an antenna module located on the broadband antenna, wherein the broadband antenna is used as an antenna radiator and/or reference ground of the antenna module. Multiple broadband antennas are realized by using only the space occupied by one broadband antenna, and other antennas are built on the broadband antenna at the same time, which maintains a good isolation between all antennas while ensuring the performance of the broadband antenna.

16 Claims, 24 Drawing Sheets

(58) Field of Classification Search
CPC ..... H01Q 1/241; H01Q 1/521; H01Q 7/00;
H01Q 9/0407; H01Q 9/42; H01Q 1/38;
H01Q 5/307; H01Q 1/50; H01Q 21/00
See application file for complete search history.

(56) References Cited

FOREIGN PATENT DOCUMENTS

| | | | | |
|---|---|---|---|---|
| FR | 3097380 | A1 | * | 12/2020 |
| KR | 20210091175 | A | * | 7/2021 |

* cited by examiner

HIGHLY-INTEGRATED VEHICLE ANTENNA CONFIGURATION

CROSS REFERENCE TO RELATED APPLICATION

The present application claims the benefit of priority to Chinese Patent Application No. CN 2020114787183, entitled "HIGHLY-INTEGRATED VEHICLE ANTENNA CONFIGURATION", filed with CNIPA on Dec. 15, 2020, the disclosure of which is incorporated herein by reference in its entirety.

FIELD OF TECHNOLOGY

The present disclosure relates to vehicle antennas, in particular, to an integrated vehicle antenna configuration.

BACKGROUND

The development of vehicle antennas has gone through a long journey, from the earliest radio broadcast antennas (AM, FM, DAB), to vehicle navigation antennas (GNSS), to satellite broadcast antennas (SDARS), to ETC antennas, and to multimedia Wi-Fi, BT, 3G/LTE, and V2X antennas. In terms of forms, antennas have evolved from external whip antennas and glass antennas to Shark-fin antennas and hidden antennas. With the advent of the 5G era, vehicles, as a part of the Internet of Things, are no longer a mere means of transportation. They will become terminal carriers, where various kinds of information converge. How to place up to a dozen of antennas in the vehicle while preserving the vehicle's aesthetic appearance and ensuring the performance of the antennas and the isolation between each other, has become a new challenge for vehicle antenna designing. External whip antennas negatively affect the appearance of the vehicle and increase the wind resistance when the vehicle is in motion, and therefore external whip antennas are fading out from the market. Shark fin antennas are more aesthetically pleasing and have a certain degree of integration. But due to their sizes and heights, the performance of shark fin antennas is poor and must be installed on the top of the vehicle. Common built-in antennas include glass antennas and box antennas placed inside the dashboard. Because these antennas are located inside the vehicle, with limited space and complex environment, their performance and integration are therefore not great. At present, a common solution is to arrange multiple antennas in different positions of the vehicle to achieve a concealed antenna arrangement, but this increases the complexity and cost of the vehicle's antenna system.

SUMMARY

The present disclosure provides a highly integrated vehicle antenna configuration, which is used to address the low performance, low integration, high complexity, and therefore high cost of built-in vehicle antennas in the prior art. This is a novel hidden highly-integrated vehicle antenna configuration, which places as many antennas as practicable in a concealed limited space.

The present disclosure provides a highly integrated vehicle antenna configuration, which is set in at least one position inside the vehicle, and the vehicle antenna configuration includes: a metal structure, which serves as a reference ground for a broadband antenna; a broadband antenna, which includes a dielectric layer and a metal layer disposed on the dielectric layer, wherein the metal layer has a continuous structure or a discontinuous structure; at least one first electrical connection structure, wherein one end of each first electrical connection structure is electrically connected to the metal structure, and the other end is electrically connected to the metal layer of the broadband antenna; at least two first excitation signal sources, loaded between the metal structure and the metal layer of the broadband antenna, wherein the first excitation signal source excites an inherent resonant mode of the metal structure and the broadband antenna, to achieve a broadband design; and at least two antenna modules, located on the broadband antenna, wherein the metal layer of the broadband antenna serves as one or more of an antenna radiator and a reference ground of the antenna module.

Alternatively, the first electrical connection structure is an outer conductor of a communication signal line and/or a metal layer wrapped around a communication signal line.

Alternatively, the broadband antenna and/or the antenna module are fed through a transmission line, and the reference ground of the transmission line has a function of the first electrical connection structure.

Alternatively, the first excitation signal sources adopt a ring excitation mode or a coupled excitation mode.

Alternatively, the antenna module includes one or more planar antennas and/or one or more non-planar antennas.

Alternatively, the planar antennas are distributed along a long side of the broadband antenna that is away from the metal structure, and the non-planar antennas are distributed along the long side of the broadband antenna away from the metal structure, or distributed along the longitudinal direction of the broadband antenna and a distance between a line segment connecting the non-planar antennas and the line bisecting the narrow side of the broadband antenna is within 10% of the length of the narrow side.

Alternatively, the non-planar antennas includes at least one or more of a SDARS antenna, GPS antenna, and ETC antenna, wherein the one or more of a SDARS antenna, GPS antenna, and ETC antenna are distributed along the longitudinal direction of the broadband antenna and a distance between the line segment connecting the non-planar antennas and the line bisecting the narrow side of the broadband antenna is within 10% of the length of the narrow side.

Alternatively, the one or more of a SDARS antenna, GPS antenna, and ETC antenna are provided with an adjusting reflector and the adjusting reflector is used to adjust the directivity of its corresponding antenna.

Alternatively, the non-planar antennas comprise at least one of a MIMO non-planar antenna and V2X non-planar antenna, and the at least one of a MIMO non-planar antenna and V2X non-planar antenna are distributed along the broadband antenna and away from the long side of the metal structure.

Alternatively, the metal layer of the broadband antenna is provided with a slot, and the slot is used to increase the isolation between the antenna modules, and the isolation between the antenna module and the first excitation signal sources.

Alternatively, the circuit board of a multimedia system of the vehicle is the broadband antenna.

Alternatively, the metal structure is a metal frame of the vehicle.

Alternatively, the metal structure is a metal plate.

Alternatively, one or more second electrical connection structures are provided between the metal plate and the metal frame, and one end of each of the second electrical connection structures is electrically connected to the metal plate, and the other end is electrically connected to the metal frame, and an orthographic projection of the metal plate onto the plane containing a surface of the metal frame of the vehicle closest to the metal plate at least partially overlaps with the metal frame of the vehicle.

Alternatively, the highly-integrated vehicle antenna configuration further comprises at least one second excitation signal source loaded between the metal plate and the metal frame, wherein the second excitation excites resonance modes of the metal plate and the metal frame to excite resonances with a selected frequency range between 80 MHz and 10000 MHz.

Alternatively, the second excitation signal source adopts a direct excitation mode or a coupled excitation mode.

As mentioned above, the highly integrated vehicle antenna configuration of the present disclosure can realize multiple broadband antennas by using only the space occupied by one broadband antenna, and at the same time construct other antennas on the broadband antenna. The highly integrated vehicle antenna configuration of the present disclosure can ensure the performance of the broadband antenna, while achieving good isolation between all the other antennas, thereby effectively improving the integration of the vehicle antenna configuration, reducing the complexity and cost of the vehicle antenna system, and making the vehicle antenna system easy to implement.

DETAILED DESCRIPTION

One or more specific embodiments of the present disclosure will be described below. These described embodiments are only examples of the presently disclosed techniques, and are not intended to limit aspects of the presently disclosed invention. Additionally, in an effort to provide a concise description of these embodiments, all features of an actual implementation may not be described in the specification. It should be appreciated that in the development of any such actual implementation, numerous implementation-specific decisions must be made to achieve the developers' specific goals, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Figure 1:
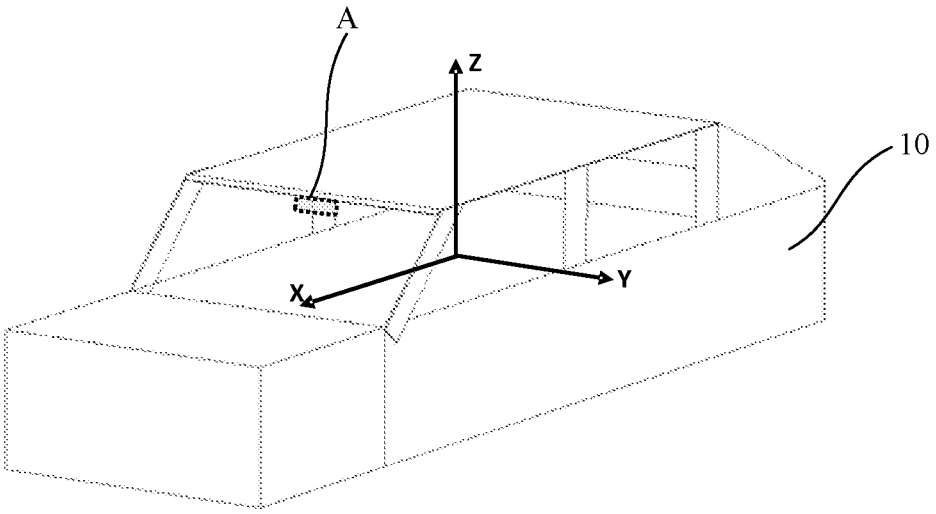
FIG. 1 shows a simplified structure diagram of a vehicle, which shows a placement position for vehicle antennas.
Figure 2:
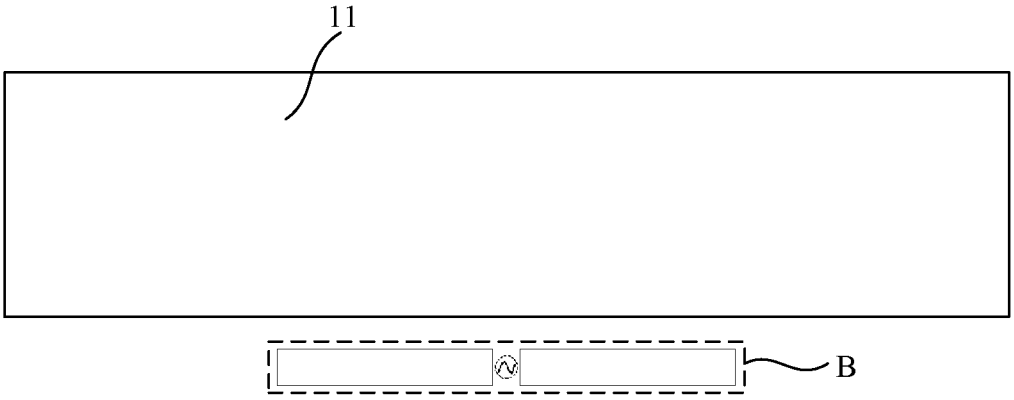
FIG. 2 shows the layout of a traditional dipole vehicle antenna.

FIG. 1 shows a simplified structure diagram of a vehicle, which shows a placement position for vehicle antennas. Some built-in vehicle antennas are placed on the vehicle's front windshield near the roof, as shown in FIG. 1 at the position A. A dipole antenna layout including a dipole B is shown in FIG. 2. To improve the degree of integration of a vehicle antenna system, an existing common method is to arrange multiple antennas in different positions of the vehicle, but this method increases the complexity and cost of the vehicle antenna systems.

Figure 3:
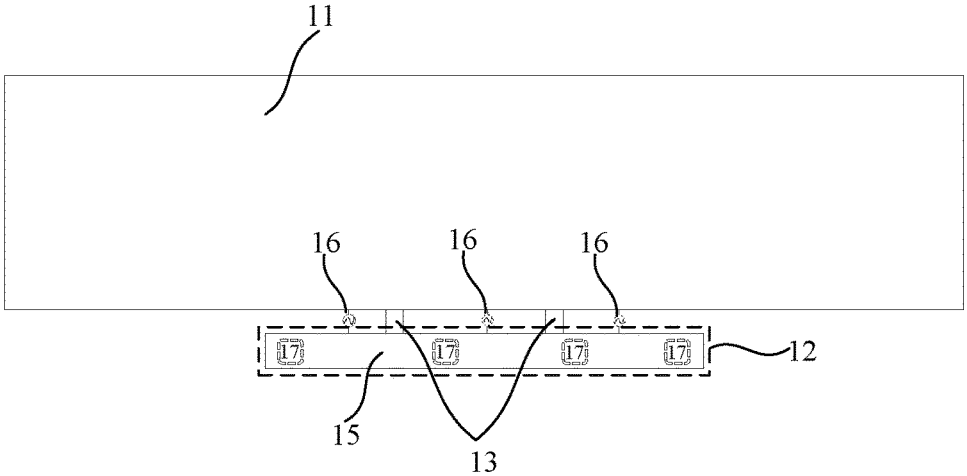
FIG. 3 shows a highly integrated vehicle antenna configuration of the present disclosure, provided with two first electrical connection structures, wherein a metal layer of a broadband antenna is continuous.

Thus, the present disclosure provides a highly integrated vehicle antenna configuration, which can integrate multiple antennas at one position inside a vehicle, and can ensure the performance and isolation of the antennas, effectively reducing the complexity and cost of the vehicle antenna system. As shown in FIG. 3, the vehicle antenna configuration includes a metal structure 11, a broadband antenna 12, at least one first electrical connection structure 13, at least two first excitation signal sources 16, and at least two antenna modules 17.

The metal structure 11 serves as a reference ground for a broadband antenna.

The broadband antenna includes a dielectric layer and a metal layer disposed on the dielectric layer.

One end of each first electrical connection structure 13 is electrically connected to the metal structure 11, and the other end is electrically connected to the metal layer 15 of the broadband antenna 12.

The at least two first excitation signal sources 16 are loaded between the metal structure 11 and the metal layer 15 of the broadband antenna 12, and the first excitation signal source 16 excites a resonant mode of the metal structure 11 and the broadband antenna 12, to achieve a broadband design.

The at least two antenna modules 17 are located on the broadband antenna 12, and the metal layer 15 of the broadband antenna 12 serves as one or more of an antenna radiator and a reference ground of the antenna module 17.

Multiple broadband antennas can be realized at the same spatial position as the broadband antenna 12, and other antennas (e.g., antenna module 17) are constructed on the broadband antenna 12, and the performance of the broadband antenna 12 is ensured while achieving better isolation between all antennas, thereby effectively improving the integration of the vehicle antenna configuration, reducing the complexity and cost of the vehicle antenna system, and making the system easy to implement. The working frequency band of the broadband antenna of the present disclosure can cover all communication frequency bands such as 2G, 3G, 4G, 5G (FR1), Navigation, BT and Wi-Fi, and can be further expanded. Further, according to the integration requirements depending on the number of vehicle antennas, the highly integrated vehicle antenna configuration can also be arranged in multiple positions inside the metal frame of the vehicle 10, and the only major requirement is that the broadband antenna 12 and the metal frame of the vehicle 10 are spaced by an interval from each other, which will allow the integration of more antennas in the vehicle antenna system.

According to the positional relationship between the first excitation signal sources 16 and the first electrical connection structure 13, the broadband antenna can be formed as open-ended or a closed-ended, as shown in FIG. 3. The two first excitation signal sources 16 on the outer side of the first electrical connection structure 13 are formed as two open-ended broadband antennas, and one of the first excitation signal sources 16 located on the inner side of the two first electrical connection structures 13 forms a closed-end broadband antenna.

Figure 4:
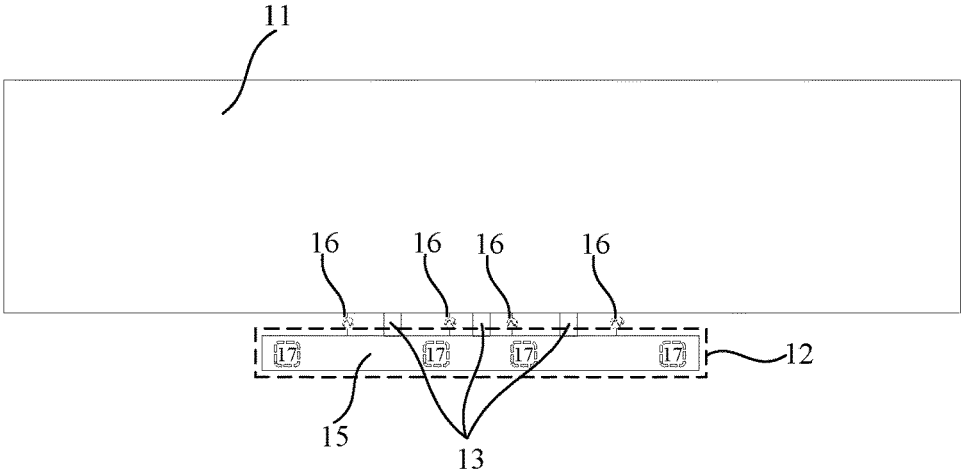
FIG. 4 shows a highly integrated vehicle antenna configuration of the present disclosure, provided with three first electrical connection structures, and a metal layer of a broadband antenna is continuous.
Figure 5:
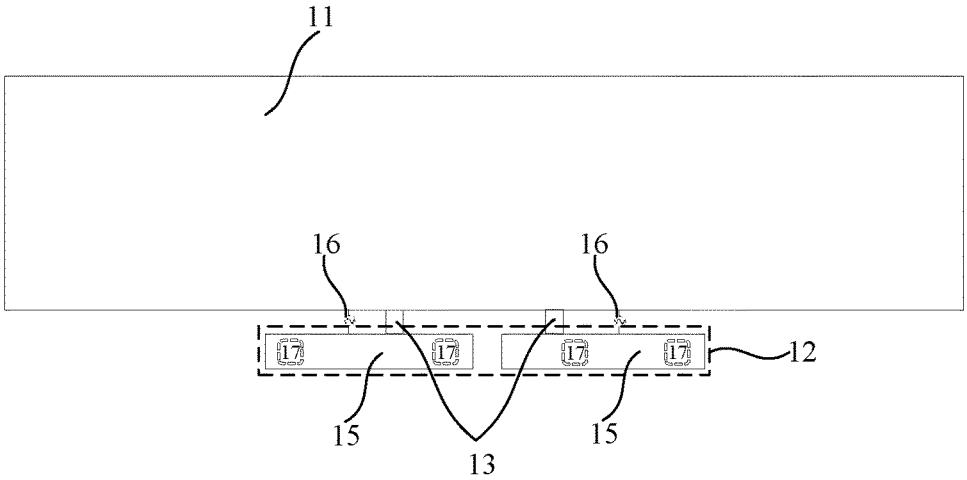
FIG. 5 shows a highly integrated vehicle antenna configuration of the present disclosure, provided with two first electrical connection structures, wherein a metal layer of the broadband antenna is discontinuous.
Figure 6:
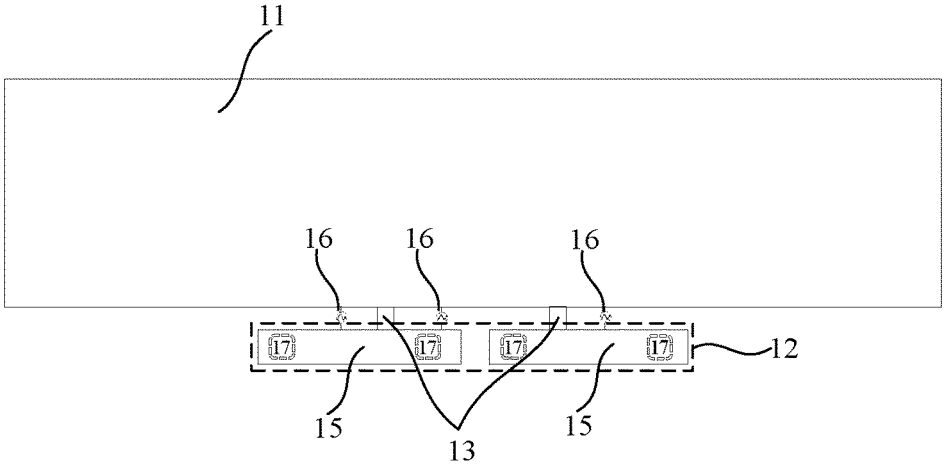
FIG. 6 shows a highly integrated vehicle antenna configuration of the present disclosure, provided with three first electrical connection structures, wherein a metal layer of the broadband antenna is discontinuous.

The metal layer 15 of the broadband antenna 12 is a metal layer with a continuous structure or a metal layer with a discontinuous structure. As shown in FIGS. 3 and 4, the metal layer 15 is a metal layer with a continuous structure; as shown in FIGS. 5 and 6, the metal layer 15 is a discontinuous structure composed of two discontinuous metal layers. Of course, it can also be composed of three or more discontinuous metal layers. The broadband antenna 12 can also be used as a circuit board of a multimedia system, such as an audio module circuit board, a camera/video module circuit board, etc.

The number of the at least one first electrical connection structure 13 may be one or more. FIGS. 3 and 5 show two first electrical connection structures 13. FIGS. 4 and 6 show three first electrical connection structures 13. In addition, the at least one first electrical connection structure 13 may be a single-function metal electrical connection line, or may be an outer conductor of a communication signal line and/or a metal layer wrapped around the communication signal line.

As an example, the broadband antenna and/or the antenna module 17 are fed through a transmission line, and the reference ground of the transmission line has the function of the first electrical connection structure 13.

Figure 7:
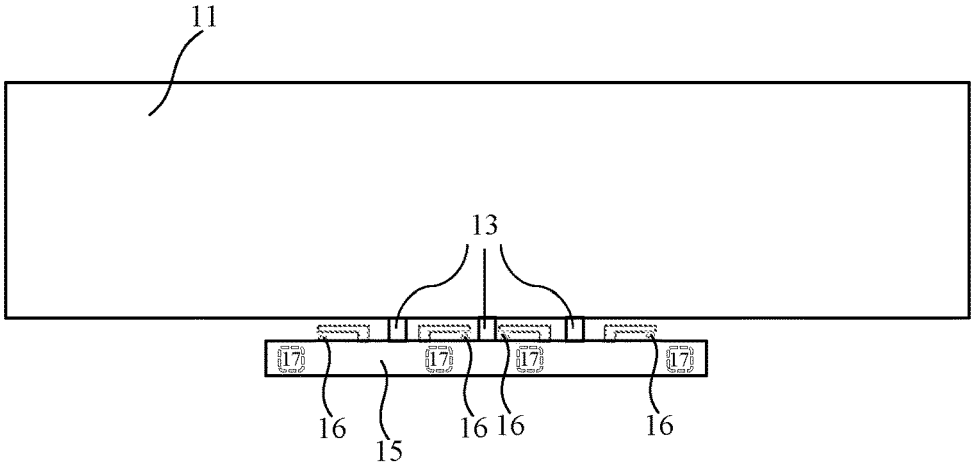
FIG. 7 shows a highly integrated vehicle antenna configuration of the present disclosure, with its first excitation signal sources adopting ring excitation.

The excitation mode of the first excitation signal sources 16 is not limited, and it may be a direct excitation mode or a coupled excitation mode. As shown in FIG. 7, the first excitation signal sources 16 adopt a direct excitation mode of ring excitation. The first excitation signal source 16 can also adopt a similar coupled excitation mode. The excitation signal source is loaded on an excitation stub electrically connected to it, and the excitation stub is coupled with other antenna stubs to radiate required electromagnetic waves. Preferably, the coupled excitation mode or the ring excitation mode can be used to further reduce the size of the broadband antenna 12.

Figure 8:
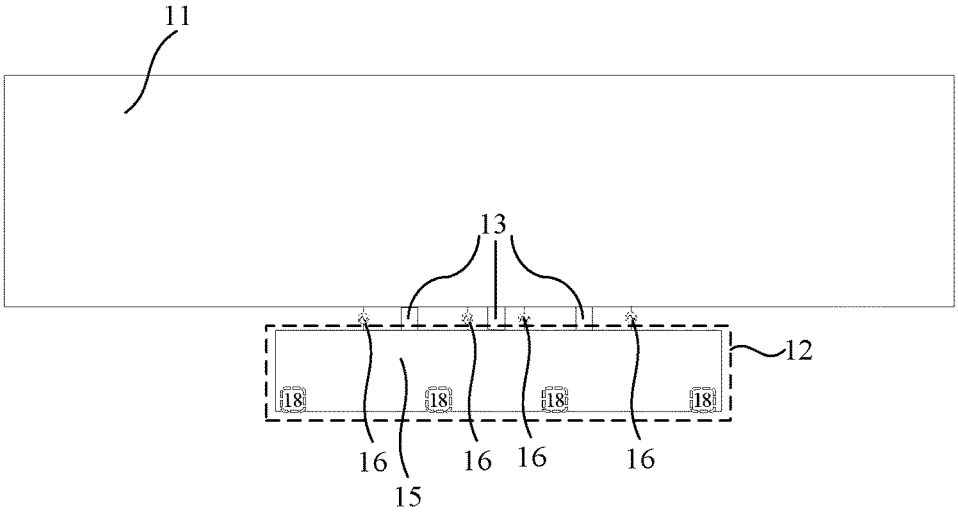
FIG. 8 shows a highly integrated vehicle antenna configuration of the present disclosure, wherein its antenna modules are planar antennas.

As an example, the antenna module may include planar antennas, non-planar antennas, or a combination of both. As shown in FIG. 8, when the antenna module includes planar antennas 18, the planar antennas 18 are arranged along the broadband antenna 12 and away from the long side of the metal structure 11 to improve the isolation between the planar antennas and broadband antenna and reserve space for other antennas.

Figure 9:
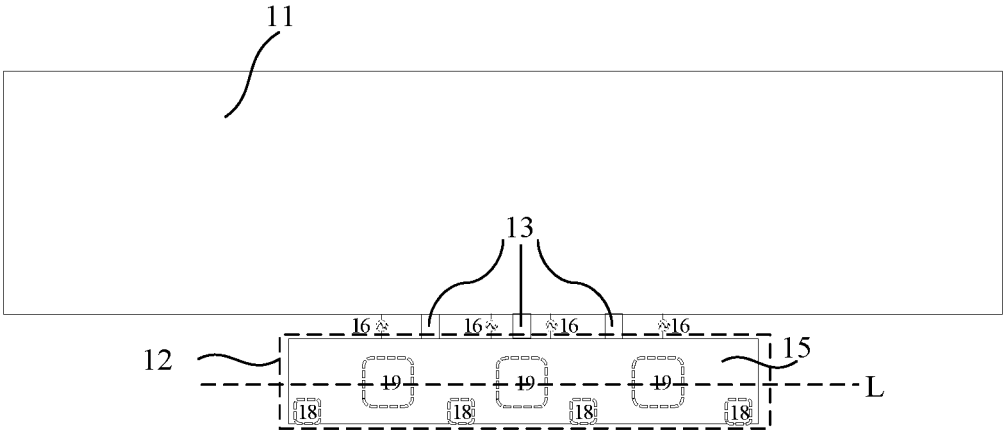
FIG. 9 shows a highly integrated vehicle antenna configuration of the present disclosure, and its antenna modules are planar antennas and non-planar antennas.

The planar antennas 18 can be formed by a process like etching or grooving the metal layer 15 of the broadband antenna 12, to form the planar antennas in a desired shape. When the antenna module includes non-planar antennas 19, the non-planar antennas 19 can be arranged along the broadband antenna 12 and away from the long side of the metal structure 11, or the non-planar antennas 19 can be are arranged along the longitudinal direction of the broadband antenna 12 and a distance between a line segment connecting the non-planar antennas and the line bisecting the narrow side of the broadband antenna 12 is within 10% of the length of the narrow side, in other words, a line segment L connecting the non-planar antennas substantially bisects the narrow side of the broadband antenna 12 (as shown in FIG. 9).

Figure 20:
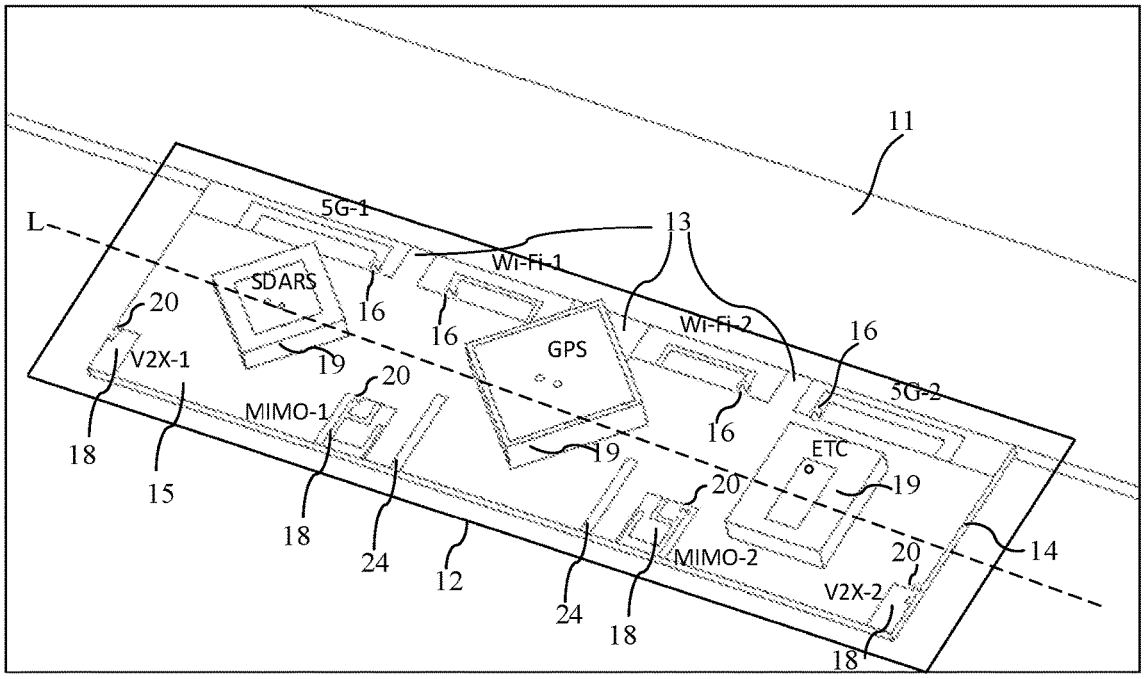
FIG. 20 is a schematic diagram showing the structure of a highly integrated vehicle antenna configuration according to Embodiment 2 of the present disclosure.

By optimizing the forms and positions of the planar antennas 18 and the non-planar antennas 19, better isolation between the broadband antenna, the planar antennas 18 and the non-planar antennas 19 can be achieved. Specifically, if the non-planar antennas 19 are used as satellite navigation antennas or directional antennas, they can be arranged along the long side of the broadband antenna 12 and a distance between a line segment connecting the non-planar antennas and the line bisecting the narrow sides of the broadband antenna 12 is within 10% of the length of the narrow sides. The reflection effect of the metal layer 15 can help realize a directional communication function. For example, as shown in FIG. 20, when the non-planar antennas 19 include one or more of a SDARS antenna, GPS antenna, and ETC antenna, the one or more of a SDARS antenna, GPS antenna, and ETC antenna are arranged along the longitudinal direction of the broadband antenna 12 and the distance between the line segment connecting the non-planar antennas and the line bisecting the narrow side of the broadband antenna 12 is within 10% of the length of the narrow side. In other words, the line segment L connecting the non-planar antennas substantially bisects the narrow side of the broadband antenna 12. In particular, the GPS antenna would be arranged at almost the center of the metal layer 15 so as to obtain a lower axial ratio. If the non-planar antennas 19 are used as omnidirectional antennas, they can be placed along the broadband antenna 12 and away from the long side of the metal structure 11, so that the reflection effect of the metal vehicle frame can help realize an omnidirectional communication function. For example, when the non-planar antennas 19 are one or more of a MIMO non-planar antenna and V2X non-planar antenna, the one or more of a MIMO non-planar antenna and V2X non-planar antenna are arranged along the broadband antenna 12 and far away from the long side of the metal structure 11.

As an example, the metal structure 11 may be a part of the metal frame of the vehicle 10. However, considering the actual installation problem between the broadband antenna 12 and the vehicle, the metal structure 11 can be replaced by a metal plate, and the metal plate 11 can be a PCB rigid board, FPC soft board and other structural parts with conductive properties. And then the metal plate 11 is fixed on the metal structure vehicle body 10 by a fixing structure.

Figure 37:
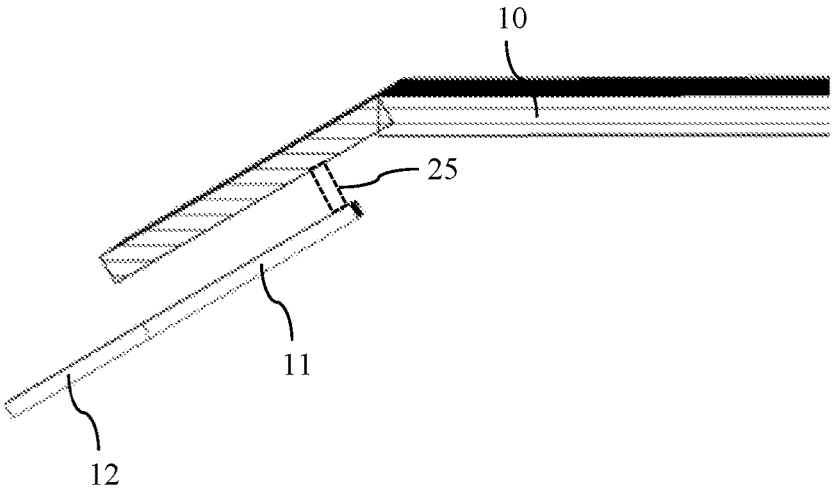
FIG. 37 shows a highly integrated vehicle antenna configuration of the present disclosure, wherein a second electrical connection structure is provided between a metal plate and a metal frame of the vehicle.

As shown in FIG. 37, as an example, the fixing structure for fixing the metal plate 11 on the metal frame of the vehicle 10 may be one or more second electrical connection structures 25, one end of the second electrical connection structures 25 is connected to the metal plate 11, and the other end is electrically connected to the metal frame of the vehicle 10. An orthographic projection of the metal plate 11 onto the plane containing a surface of the metal frame of the vehicle 10 closest to the metal plate 11 at least partially overlaps with the metal frame of the vehicle 10.

Figure 38:
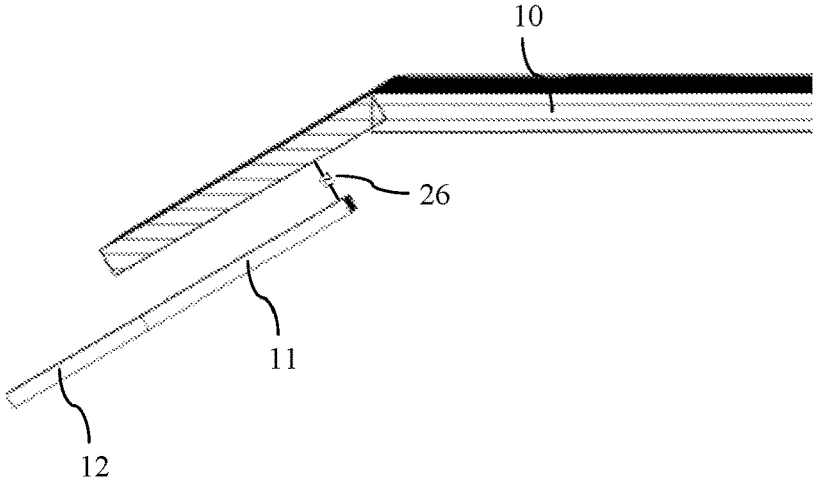
FIG. 38 shows a highly integrated vehicle antenna configuration of the present disclosure, wherein a second excitation signal source is loaded between a metal plate and a metal frame of the vehicle.
Figure 39:
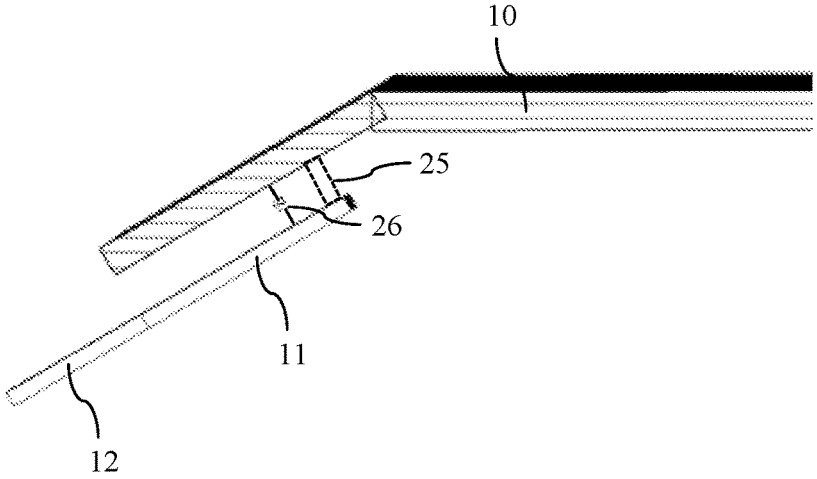
FIG. 39 shows a highly integrated vehicle antenna configuration of the present disclosure, wherein a metal plate and a metal frame of the vehicle form an antenna with a single feed point and a single ground.
Figure 40:
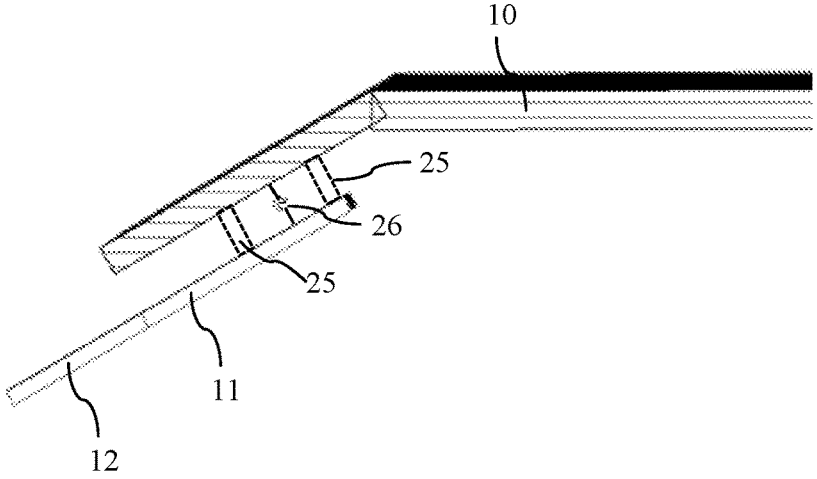
FIG. 40 shows a highly integrated vehicle antenna configuration of the present disclosure, wherein a metal plate and a metal frame of the vehicle form an antenna with a single feed point and multiple grounds.
Figure 41:
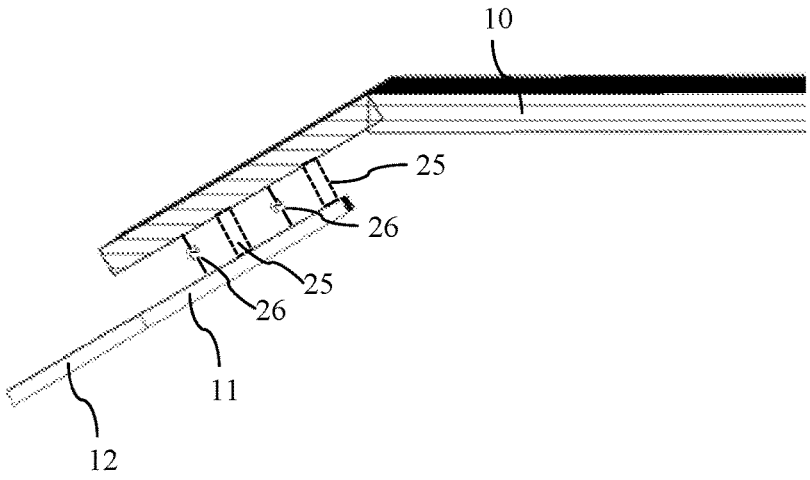
FIG. 41 shows a highly integrated vehicle antenna configuration of the present disclosure, wherein a metal plate and a metal frame of the vehicle form an antenna with multiple feed points and multiple grounds.

As shown in FIGS. 38 to 41, preferably, by loading one or more second excitation signal sources 26 between the metal plate 11 and the metal frame of the vehicle 10, and according to the number of the second electrical connection structures 25 and the second excitation signal sources 26, an antenna with a single feed point (as shown in FIG. 38), or an antenna with a single feed point and single ground (as shown in FIG. 39), or an antenna with a single feed point and multiple grounds (as shown in FIG. 40), or an antenna with multiple feed points and multiple grounds (as shown in FIG. 41) can be formed between the metal plate 11 and the metal frame of the vehicle 10. The second excitation signal sources 26 excite resonance modes of the metal plate 11 and the metal frame of the vehicle 10, to excite resonances with a selected frequency range between 80 MHz and 10000 MHz, which can be used in antennas for FM, RKE, DAB, DTV, 2G, 3G, 4G, 5G (FR1), Wi-Fi, UWB, etc. The antennas with such a configuration help realize a hidden vehicle antenna configuration of the present disclosure, which is more convenient to implement. As an example, the second excitation signal source 26 may adopt a direct excitation mode or a coupled excitation mode.

As shown in FIG. 20, as an example, the metal layer 15 of the broadband antenna is provided with a slot 24, and the slot 24 is used to increase isolation between the antenna modules (including non-planar antennas 19 for example), and the isolation between the antenna modules and the first excitation signal sources 16.

The highly integrated vehicle antenna configuration of the present disclosure will be described in detail below in conjunction with specific drawings and corresponding embodiments. Obviously, the described embodiments are only a part of the embodiments of the present disclosure, but not all of the embodiments. Based on the embodiments provided by the present disclosure, all other embodiments obtained by those skilled in the art without creative work shall fall within the scope of the present disclosure.

Embodiment 1

Figure 10:
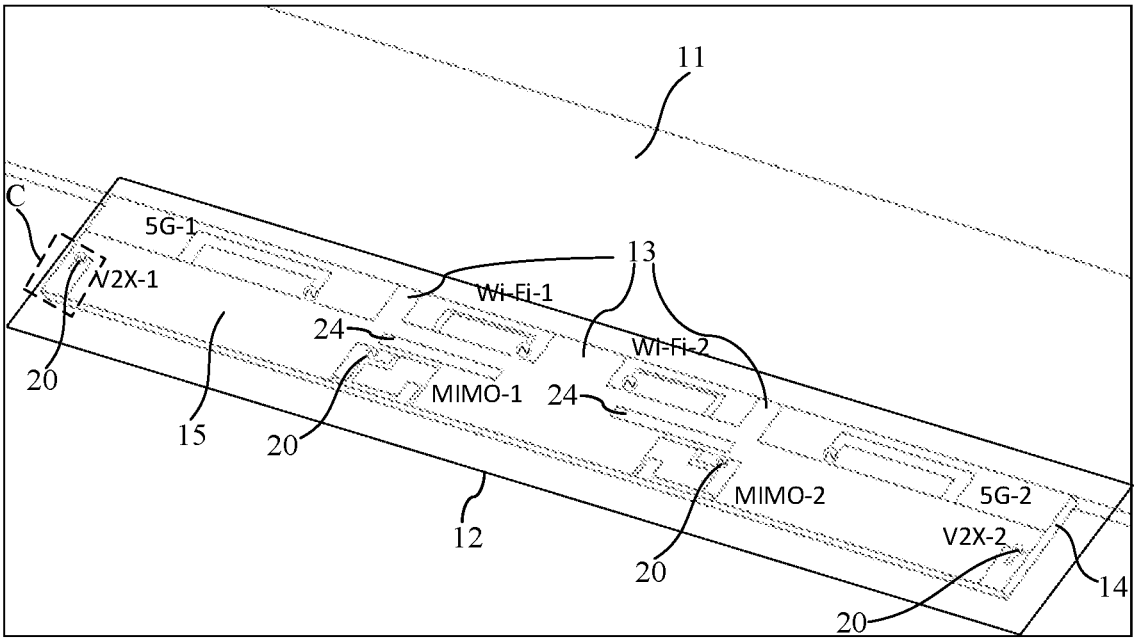
FIG. 10 is a schematic diagram showing the structure of a highly integrated vehicle antenna configuration according to Embodiment 1 of the present disclosure.
Figure 11:
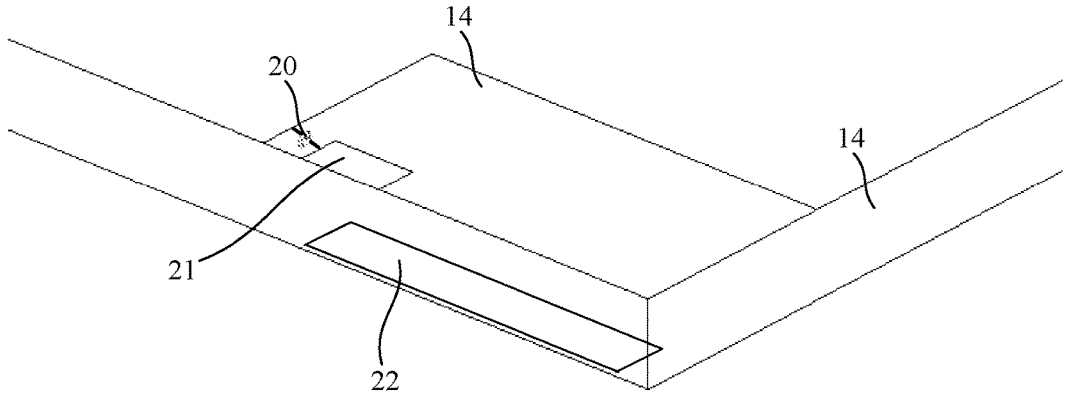
FIG. 11 is a partial enlarged view of the dotted frame C in FIG. 10.

As shown in FIG. 10, the dimensions of the broadband antenna 12 are 200 mm*20 mm*2 mm, the number of the first electrical connection structures 13 is 3, and the antenna modules include 4 planar antennas. As shown in FIG. 10, the broadband antennas include two 5G antennas 5G-1, 5G-2, and two dual-band (2.4 GHz and 5 GHz) Wi-Fi antennas Wi-Fi-1, Wi-Fi-2, with working frequency bands of 600 MHz~6000 MHz; the planar antennas include two MIMO antennas MIMO-1, MIMO-2, with working frequency bands of 1700 MHz to 6000 MHz, and two V2X antennas V2X-1 and V2X-2, with working frequency bands of 5905 MHz to 5925 MHz. The 5G antennas and the Wi-Fi antennas are excited by ring feeding to reduce the size of the broadband antenna 12. For better antenna isolation, four of the planar antennas are arranged on one side of the long side of the broadband antenna 12, and this long side is far away from the metal structure 11; among them, the two V2X antennas are arranged at two ends on the long side, and adopt the coupled excitation dipole form as shown in FIG. 11. Specifically, an excitation stub 21 is formed by etching, grooving, and other treatments of the metal layer 15 of the broadband antenna 12. Third excitation signal sources 20 are loaded on the excitation stub 21, so that the excitation stub 21 couples and excites antenna stub 22 disposed on a lower surface of the dielectric layer 14, so that the antenna stub 22 works in a dipole antenna mode. Through optimizing the layout and forms of the two V2X antennas, better horizontal plane gain coverage of the V2X antenna is achieved. The slot 24 is arranged along the long side of the broadband antenna, and the slot 24 is arranged between adjacent Wi-Fi antenna and MIMO antenna to improve the isolation between the MIMO antenna and the Wi-Fi antenna. In this embodiment, the antennas are arranged symmetrically, that is, there are two 5G antennas, two Wi-Fi antennas, two V2X antennas, and two MIMO antennas, which are all symmetrically designed. For simplicity of description, functional descriptions of only four antennas on one side, namely the 5G-1 antenna, Wi-Fi-1 antenna, V2X-1 antenna and MIMO-1 antenna, are given.

Figure 12:
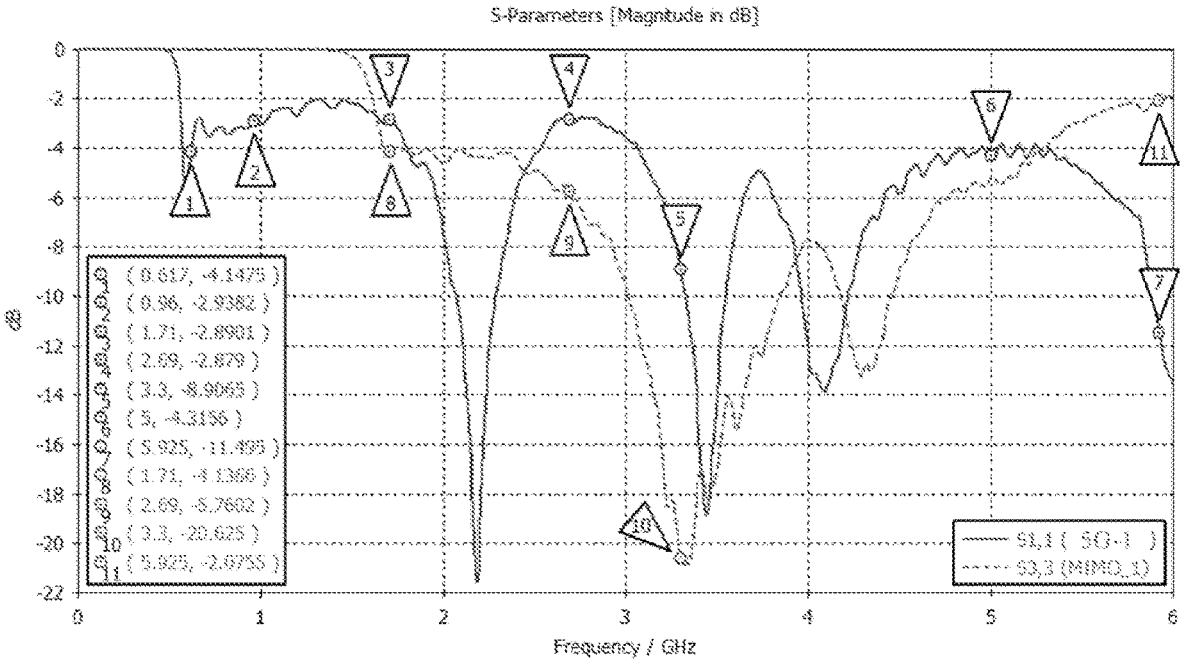
FIG. 12 shows a simulated return loss diagram of a 5G-1 antenna and a MIMO-1 antenna in a highly integrated vehicle antenna configuration according to Embodiment 1 of the present disclosure.
Figure 13:
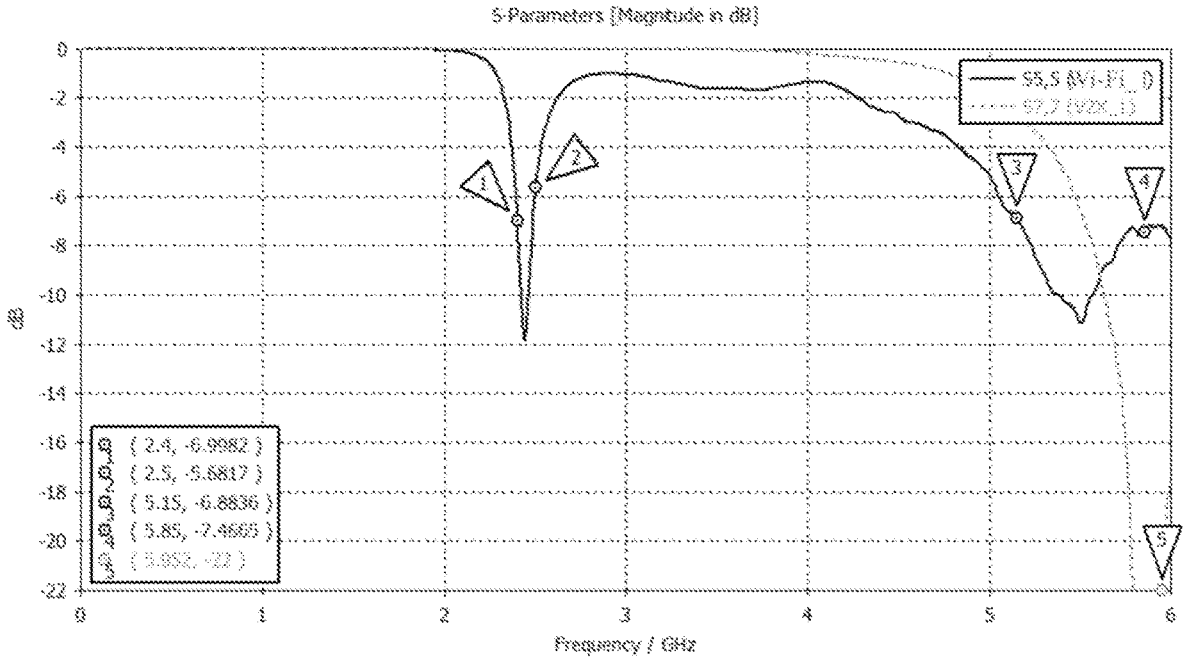
FIG. 13 shows a simulated return loss diagram of a V2X-1 antenna and a WiFi-1 antenna in a highly integrated vehicle antenna configuration of the Embodiment 1 of the present disclosure.
Figure 14:
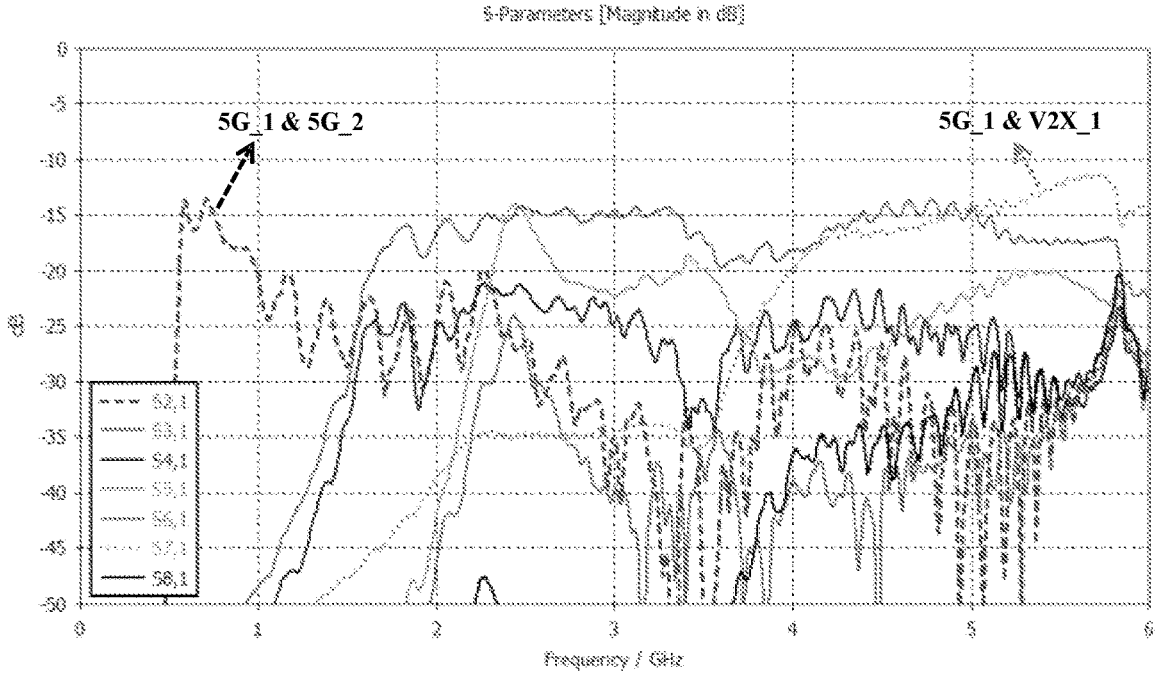
FIGS. 14-17 show simulated isolation diagrams of antennas of a highly integrated vehicle antenna configuration according to Embodiment 1 of the present disclosure.
Figure 15:
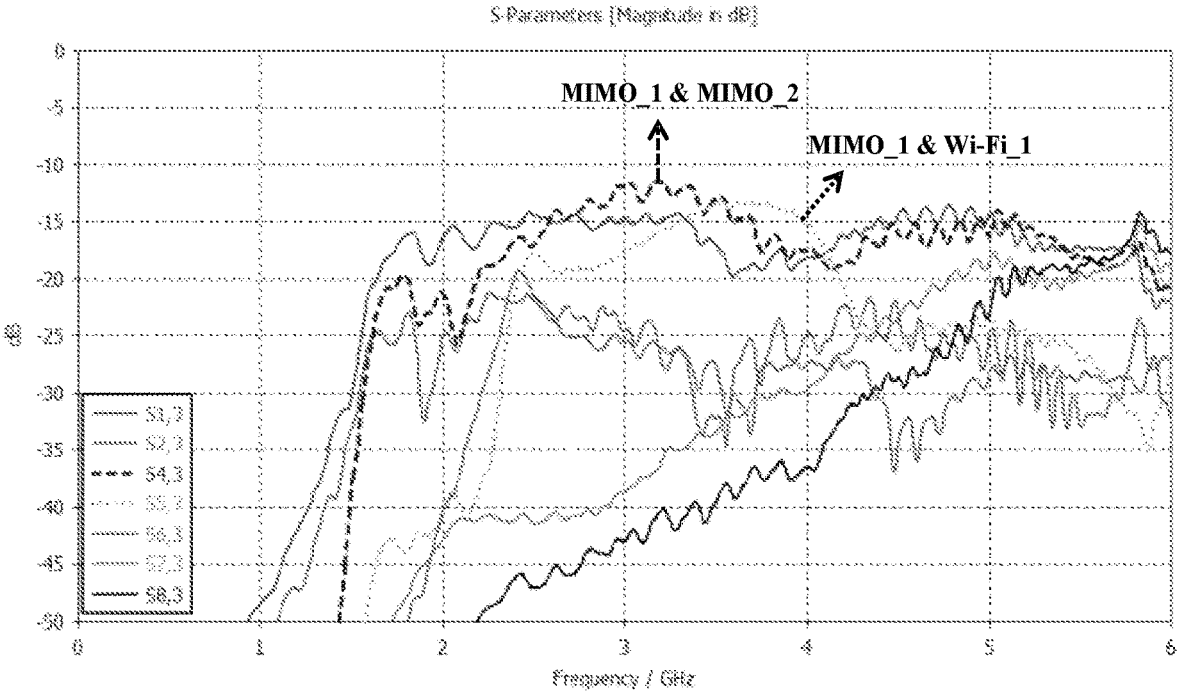
Figure 16:
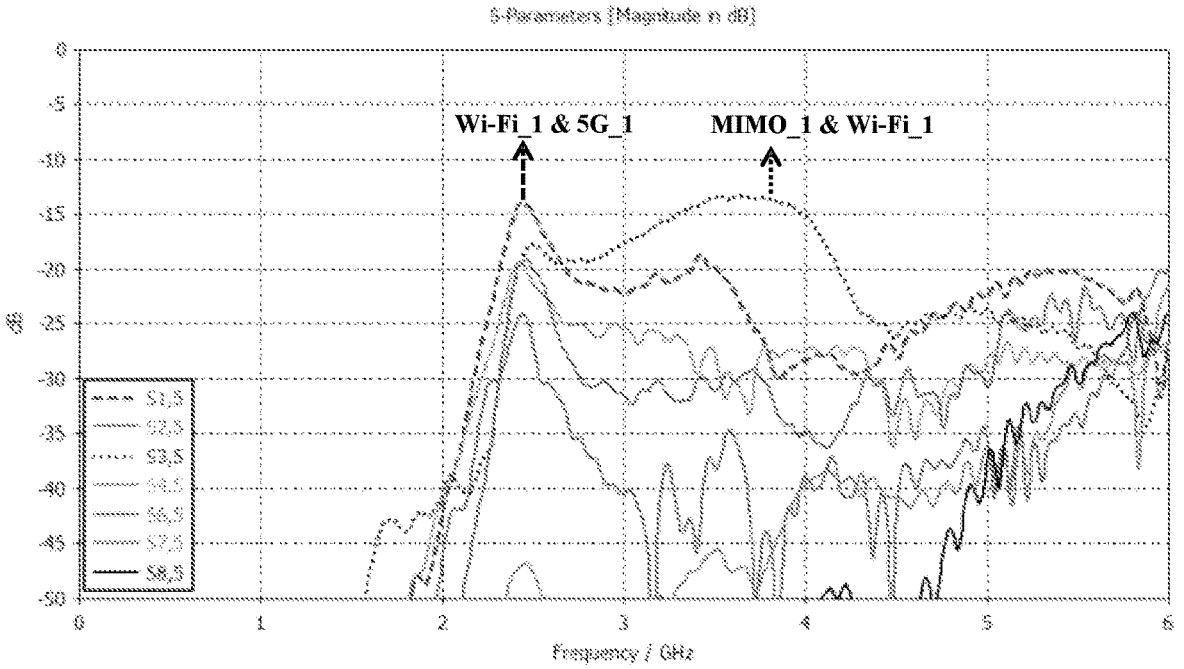
Figure 17:
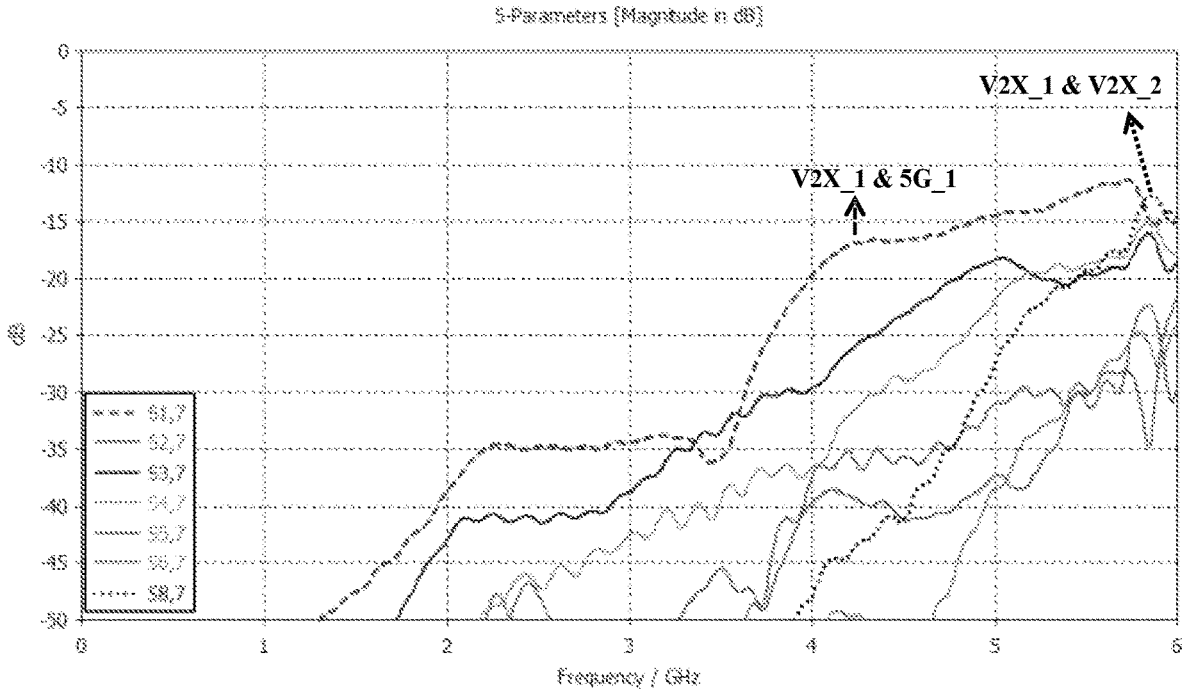

FIGS. 12 and 13 are simulated return loss diagrams of the 5G antennas, MIMO antennas, Wi-Fi antennas and V2X antennas of this embodiment.

FIGS. 14 to 17 are simulated isolation diagrams of the 5G antennas, MIMO antennas, Wi-Fi antennas and V2X antennas of this embodiment. The numbers 1 to 8 represent the 5G-1 antenna, 5G-2 antenna, and MIMO-1 antenna, MIMO-2 antenna, Wi-Fi-1 antenna, Wi-Fi-2 antenna, V2X-1 antenna, V2X-2 antenna respectively.

Figure 18:
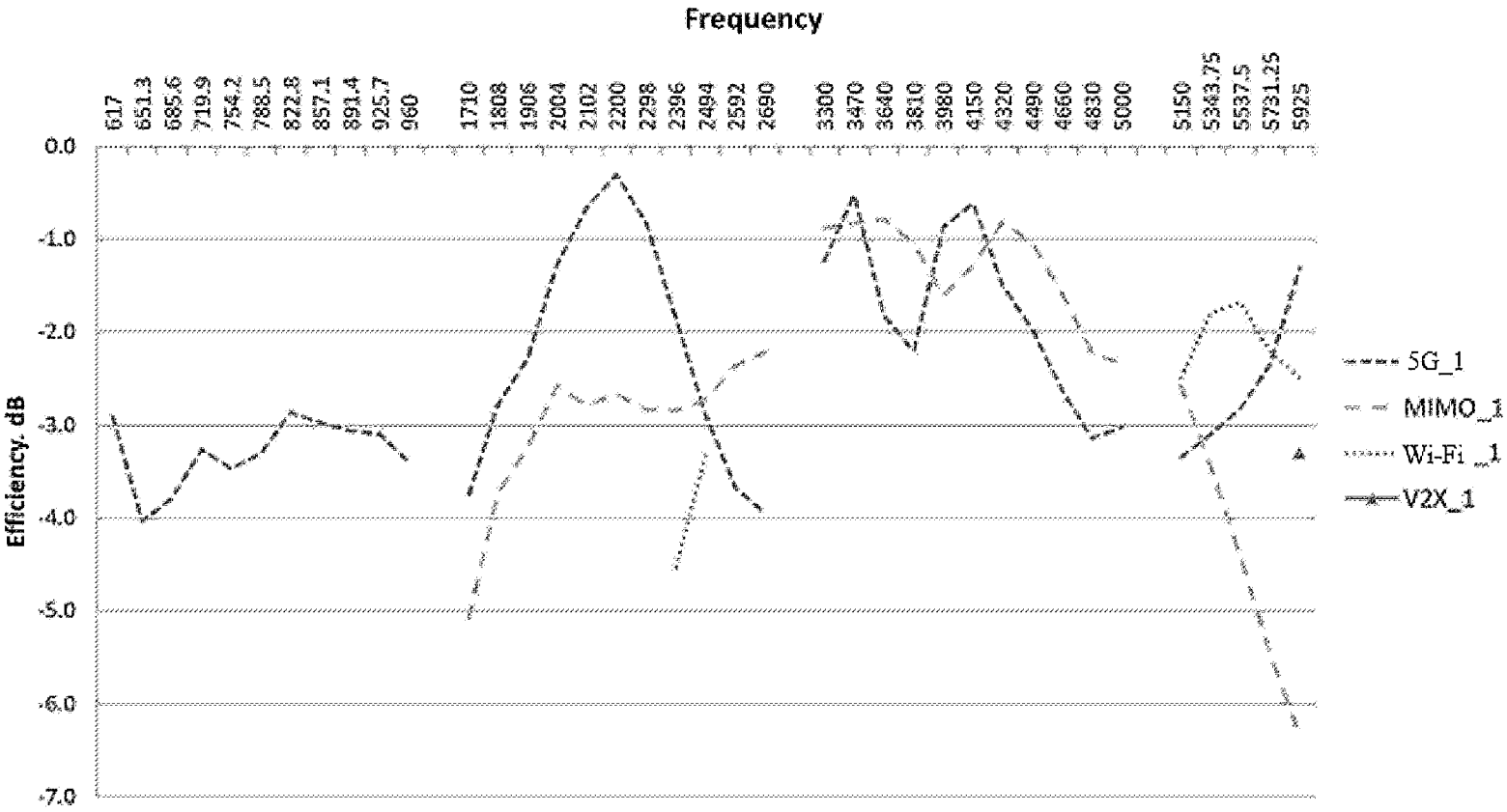
FIG. 18 shows an antenna simulated efficiency diagram of a highly integrated vehicle antenna configuration according to Embodiment 1 of the present disclosure.

FIG. 18 is a simulated efficiency diagram of the 5G-1 antenna, Wi-Fi-1 antenna, V2X-1 antenna and MIMO-1 antenna of this embodiment. It is easy to see from the simulated results that the isolation between the antennas is better than −10 dB, and their performance meets working requirements.

Figure 19:
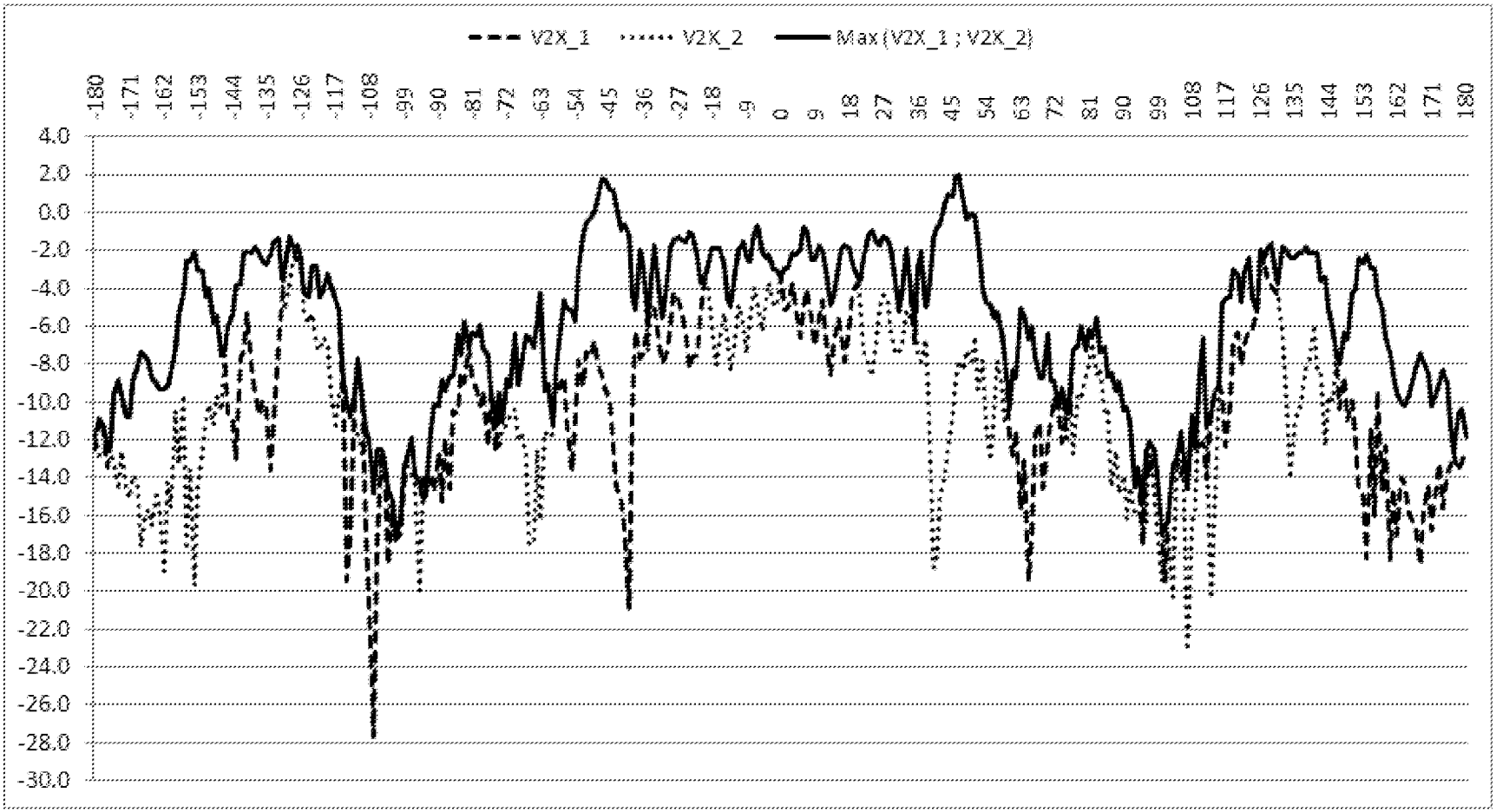
FIG. 19 is a horizontal plane gain coverage diagram of a V2X antenna in a highly integrated vehicle antenna configuration according to Embodiment 1 of the present disclosure.

FIG. 19 shows a gain coverage performance diagram of the two V2X antennas V2X-1 and V2X-2 in the horizontal plane. The difference between the maximum and minimum gains is ≤20 dB, which meets the acceptable performance requirements.

Embodiment 2

As shown in FIG. 9 and FIG. 20, the dimensions of the broadband antenna 12 are 150 mm*45 mm*2 mm, the number of the first electrical connection structures 13 is three, and the antenna modules include four planar antennas 18 and three non-planar antennas 19.

As shown in FIG. 20, the broadband antennas include two 5G antennas 5G-1, 5G-2 with working frequency bands of 600 MHz-6000 MHz and two dual-band (2.4 GHz and 5 GHz) Wi-Fi antennas Wi-Fi-1, Wi-Fi-2; the planar antennas include two MIMO antennas MIMO-1, MIMO-2, with working frequency bands of 1700 MHz-6000 MHz and two V2X antennas V2X-1, V2X-2, with working frequency bands of 5905 MHz-5925 MHz. These antennas' layouts and excitation methods are similar to those of Embodiment 1. A slot 24 extending along the short side of the broadband antenna 12 is arranged between the two MIMO antennas to improve the isolation between the two MIMO antennas.

The three non-planar antennas are a SDARS antenna, GPS antenna and ETC antenna from left to right. Both the SDARS antenna and the GPS antenna adopt a dual-feed point circular polarization design, the GPS antenna is arranged at the center of the metal layer 15, and the ETC antenna is a single-feed point design. Both the SDARS antenna and GPS antenna adopt ceramic materials with a relative dielectric constant of 18 as the base material, and the ETC antenna adopt a material with a relative dielectric constant of 3 as the base material. In the same way, the planar antennas and broadband antennas on both sides of this embodiment are designed symmetrically. For simplicity of description, only the performance of four antennas on one side is given, namely 5G-1 antenna, Wi-Fi-1 antenna, V2X-1 antenna, and MIMO-1 antenna.

Figure 21:
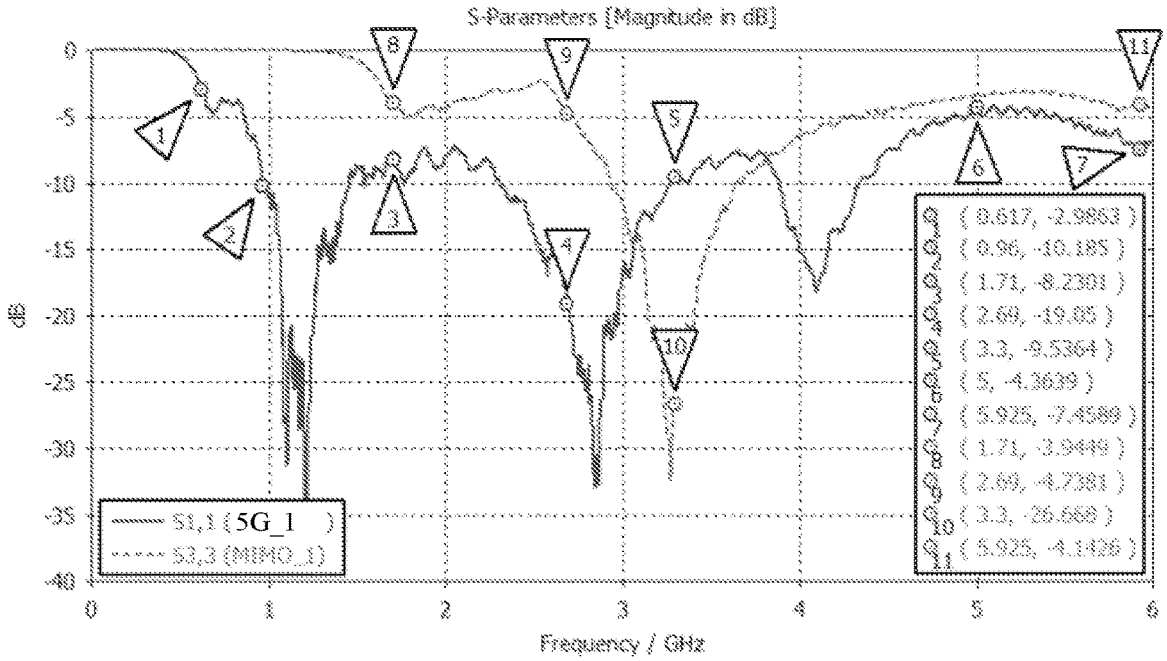
FIG. 21 shows a simulated return loss diagram of a 5G-1 antenna and a MIMO-1 antenna in a highly integrated vehicle antenna configuration according to Embodiment 2 of the present disclosure.

FIG. 21 is a simulated return loss diagram of the 5G-1 antenna, and MIMO-1 antenna of this embodiment.

Figure 22:
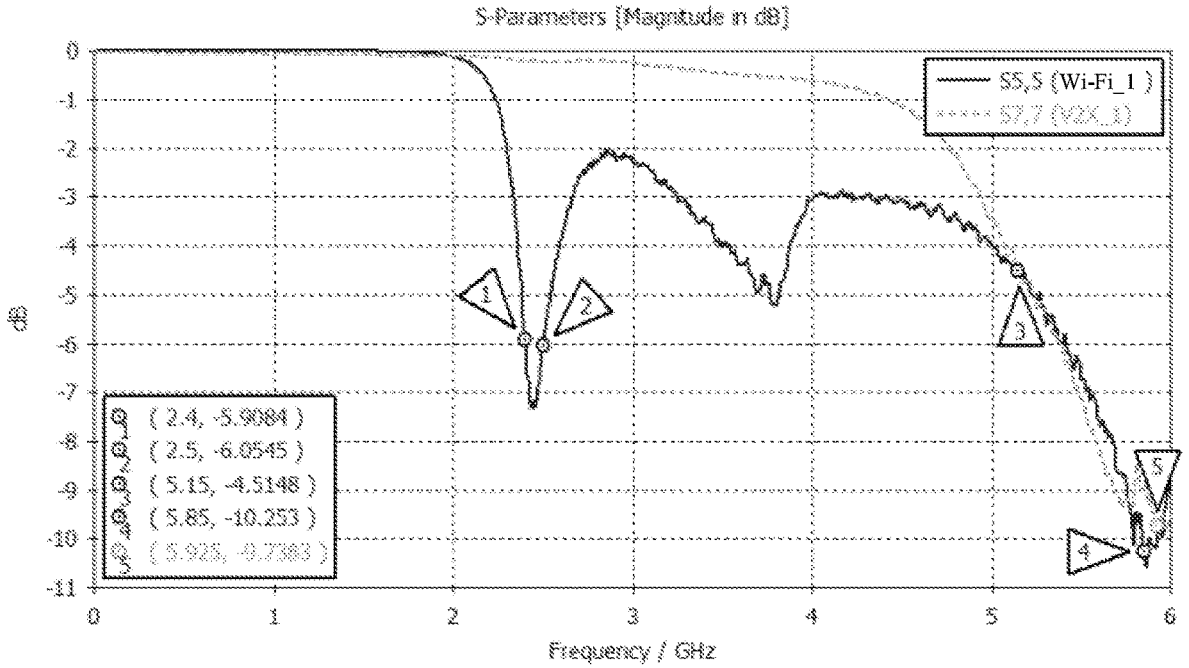
FIG. 22 shows a simulated return loss diagram of a V2X-1 antenna and a WiFi-1 antenna in a highly integrated vehicle antenna configuration according to Embodiment 2 of the present disclosure.
Figure 23:
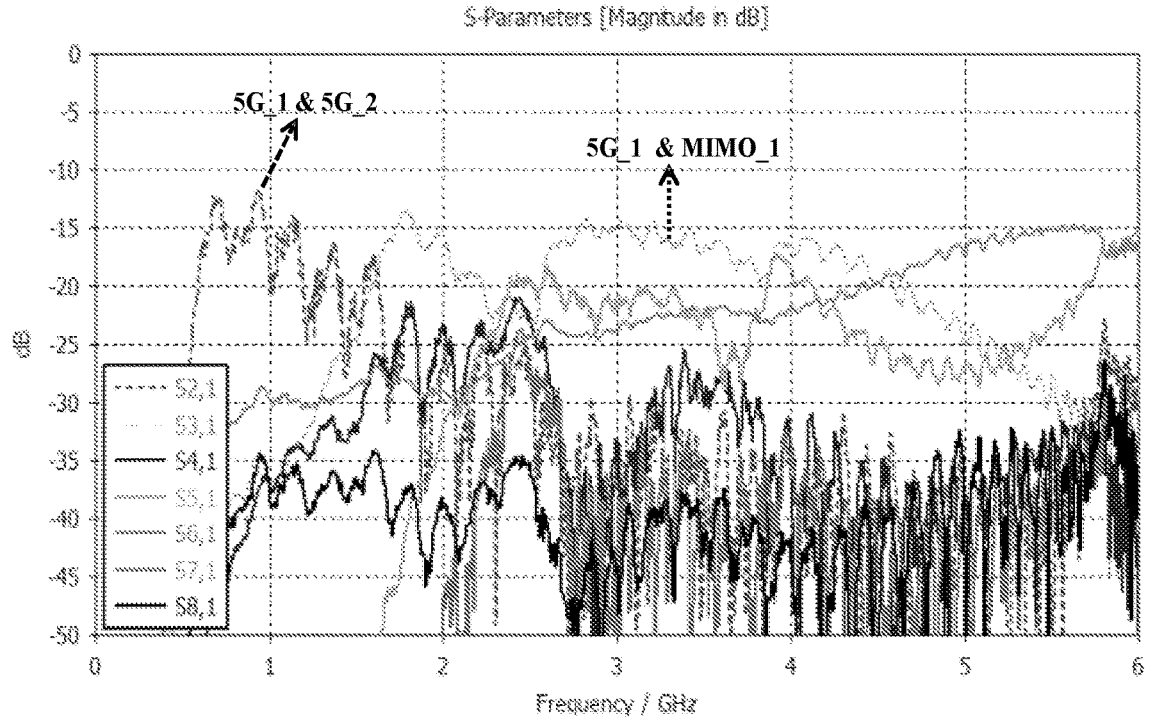
FIGS. 23 to 26 show simulated isolation diagrams of antennas of a highly integrated vehicle antenna configuration according to Embodiment 2 of the present disclosure.
Figure 24:
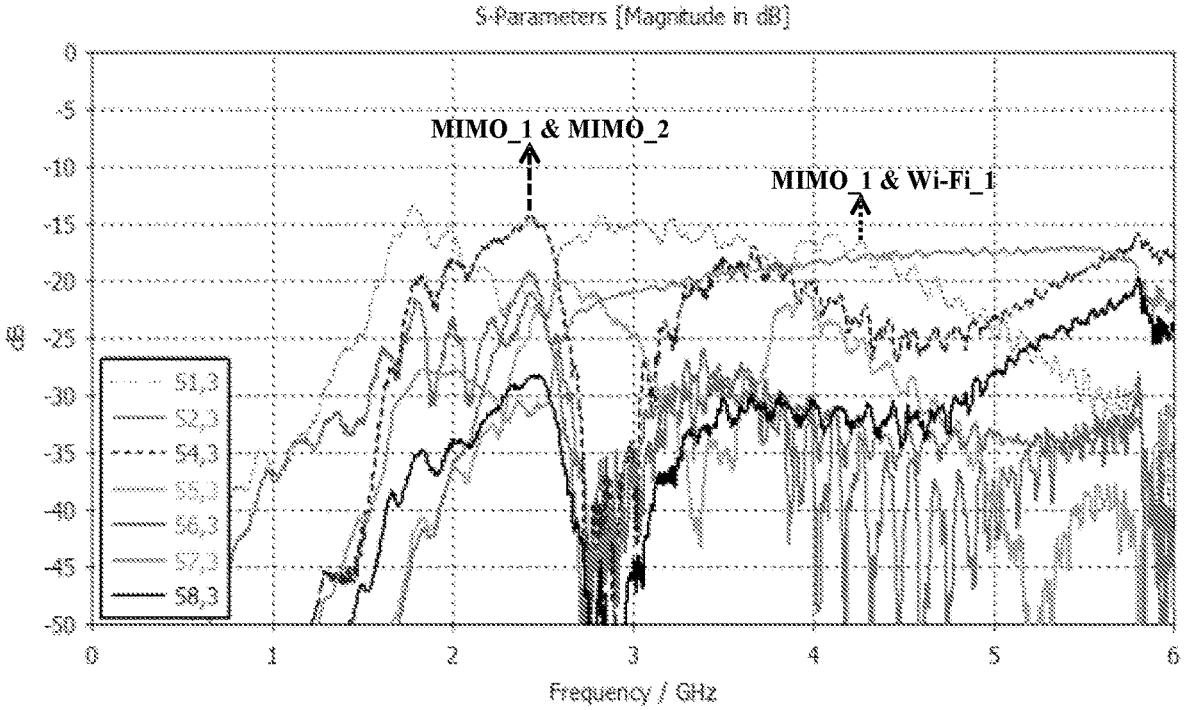
Figure 25:
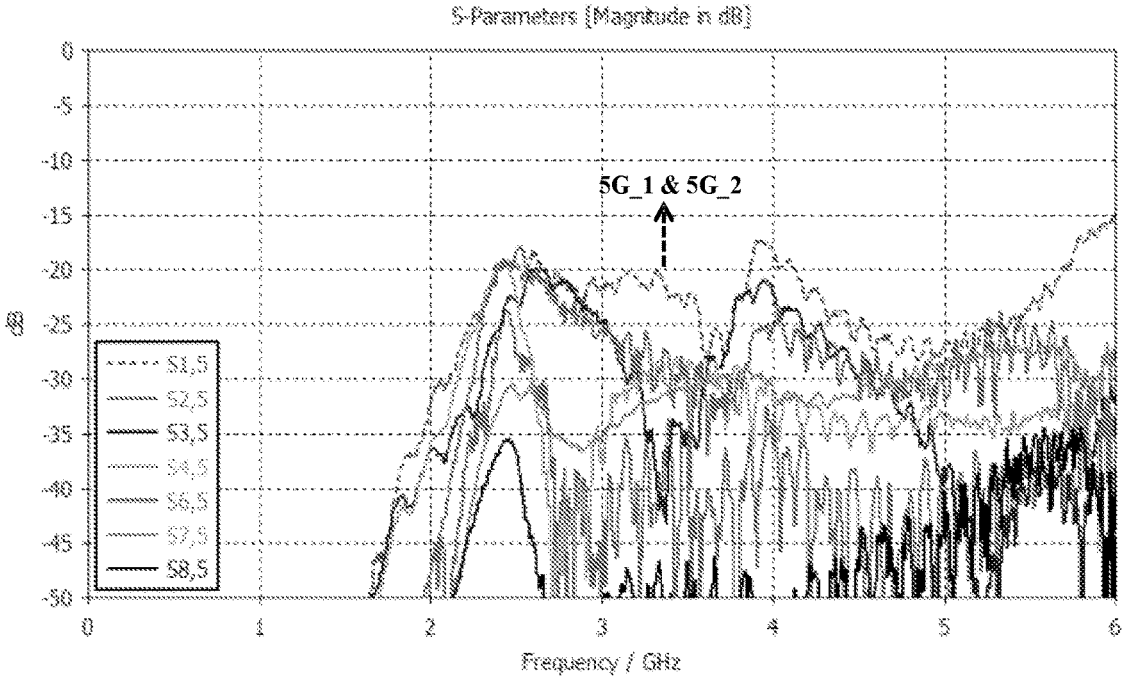
Figure 26:
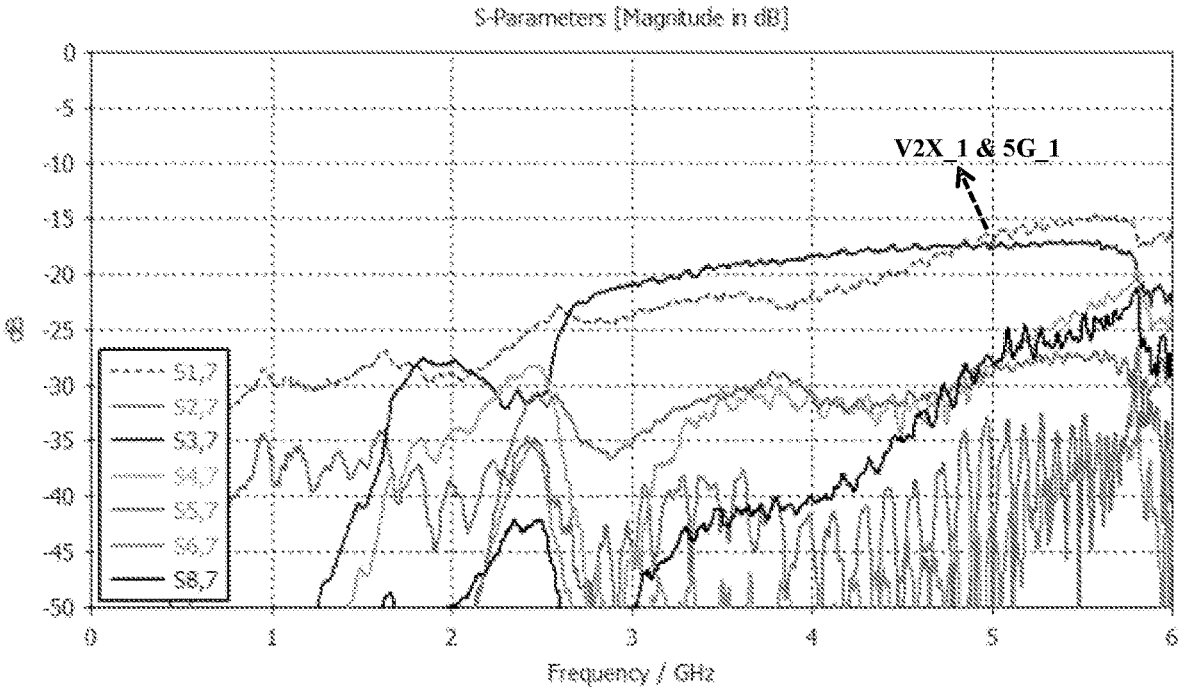

FIG. 22 is a simulated return loss diagram of a V2X-1 antenna and a Wi-Fi-1 antenna of this embodiment.

FIGS. 23 to 26 are simulated isolation diagrams of the 5G antennas, MIMO antennas, Wi-Fi antennas and V2X antennas of this embodiment. The numbers 1 to 8 represent 5G-1 antenna, 5G-2 antenna, MIMO-1 antenna, MIMO-2 antenna, Wi-Fi-1 antenna, Wi-Fi-2 antenna, V2X-1 antenna, and V2X-2 antenna respectively.

Figure 27:
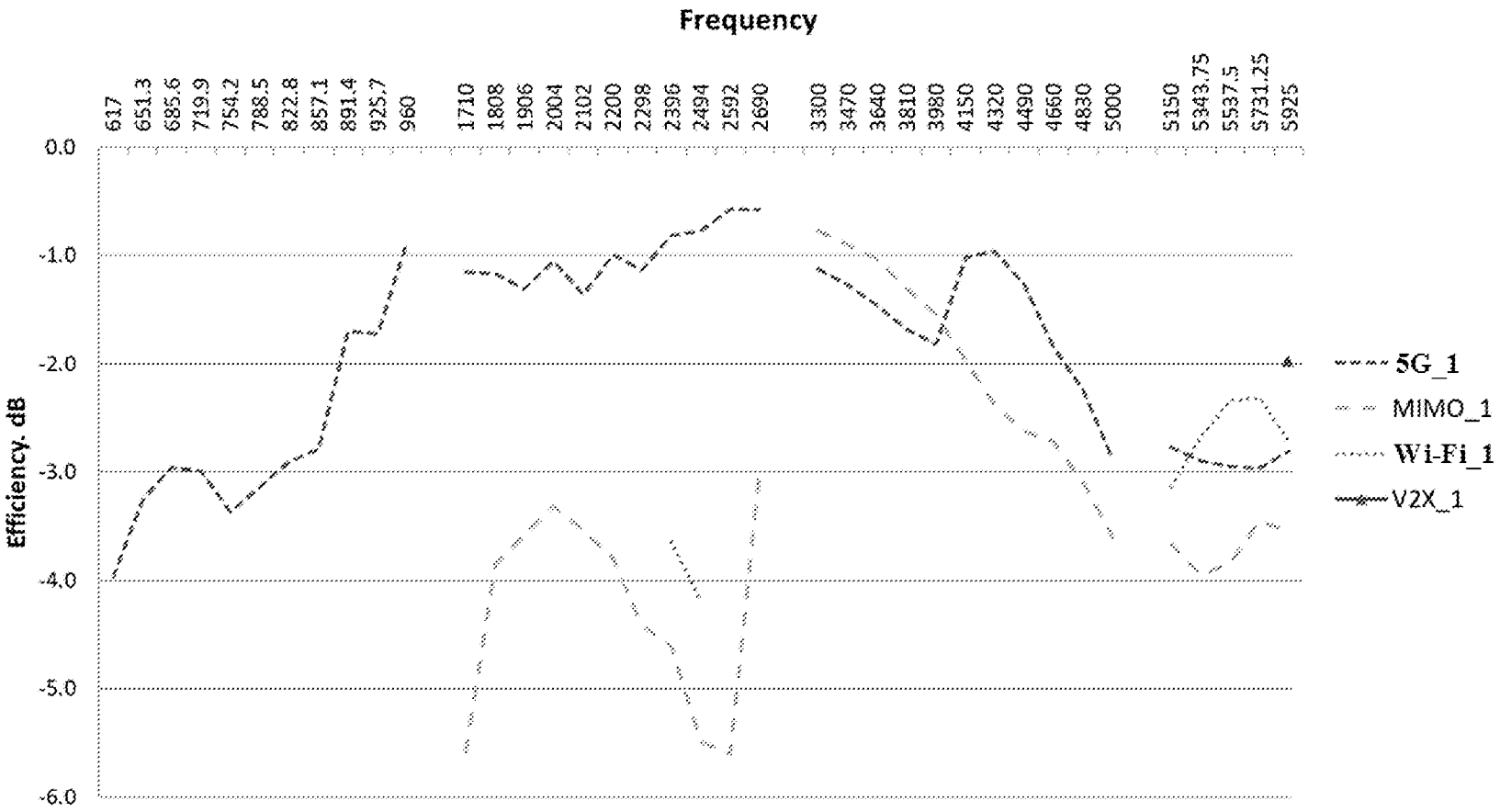
FIG. 27 shows an antenna simulated efficiency diagram of a highly integrated vehicle antenna configuration according to Embodiment 2 of the present disclosure.

FIG. 27 is a simulated efficiency diagram of the 5G-1 antenna, Wi-Fi-1 antenna, V2X-1 antenna, and MIMO-1 antenna of this embodiment. It is easy to see from the simulated results that the isolation between the antennas is better than −10 dB, and the antenna radiation efficiency and other performance indicators basically meet the working requirements.

Figure 28:
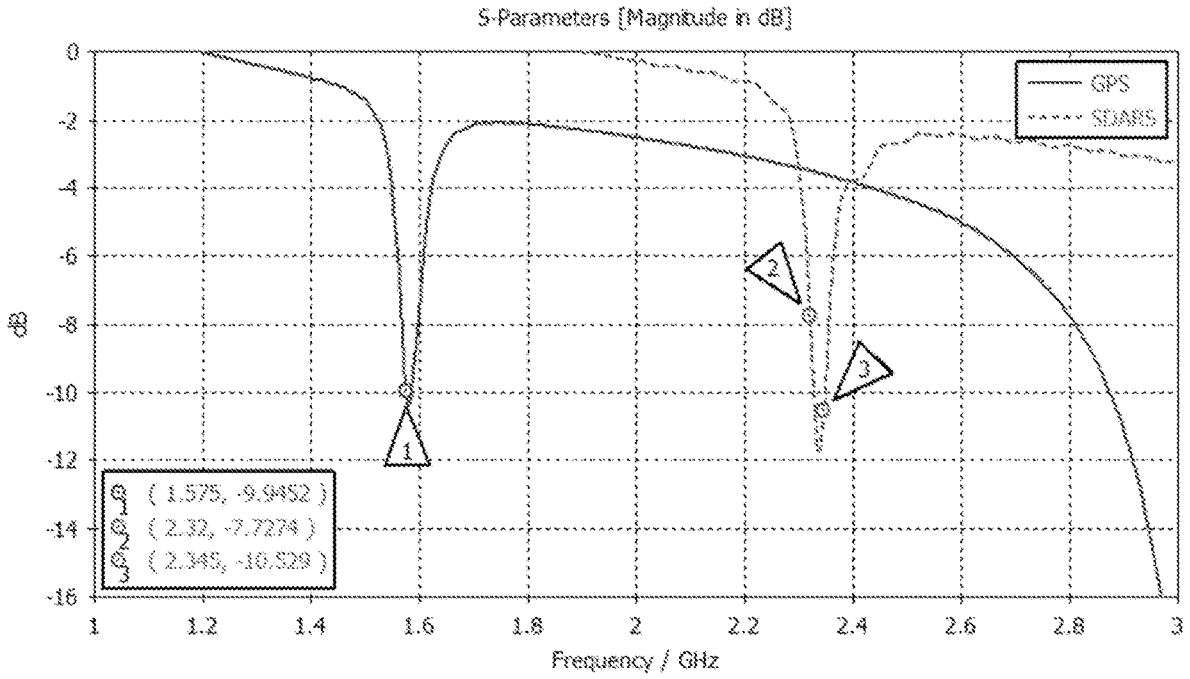
FIGS. 28 and 29 show simulated return loss diagrams of a GPS antenna, SDARS antenna, and ETC antenna in a highly integrated vehicle antenna configuration according to Embodiment 2 of the present disclosure.
Figure 29:
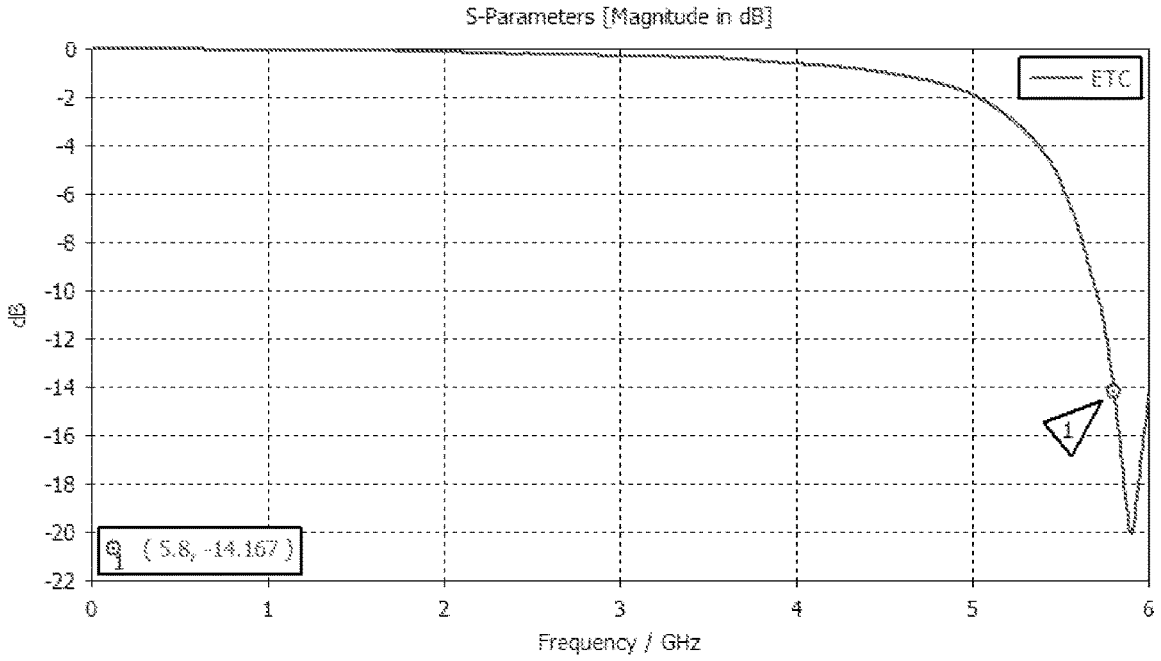

FIG. 28 and FIG. 29 are simulated return loss diagrams of three non-planar antennas, i.e., a GPS antenna, SDARS antenna, and ETC antenna.

Figure 30:
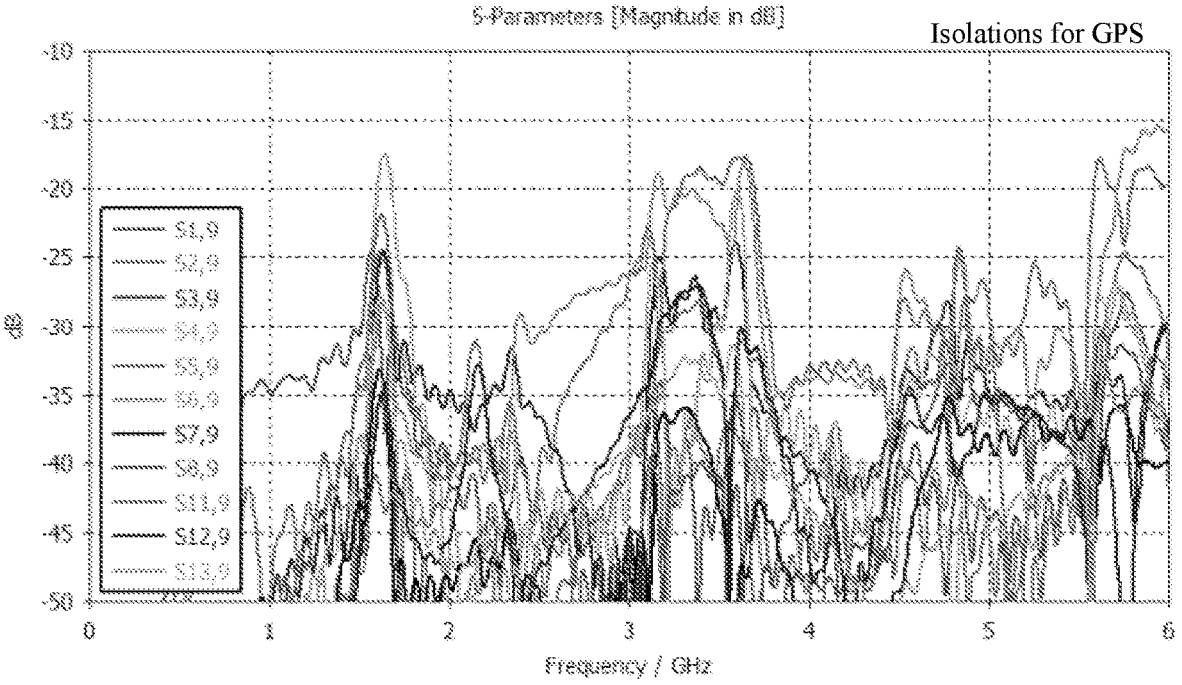
FIGS. 30 to 32 show simulated isolation diagrams of a GPS antenna, SDARS antenna, and ETC antenna in a highly integrated vehicle antenna configuration according to Embodiment 2 of the present disclosure.
Figure 31:
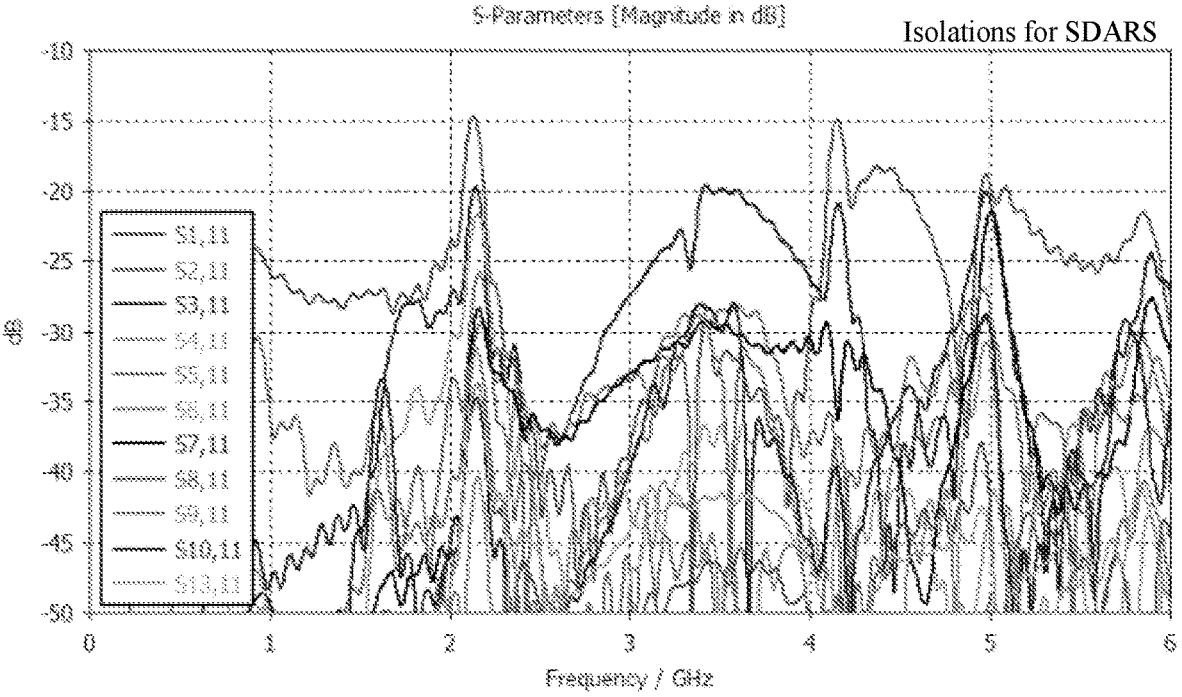
Figure 32:
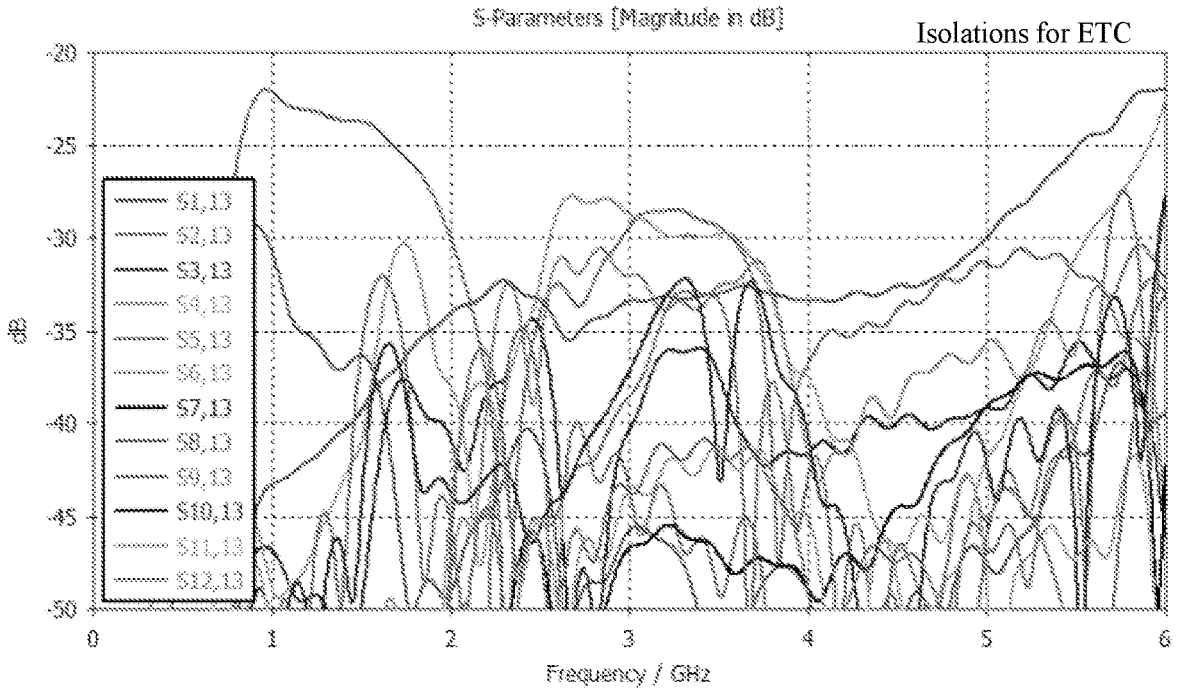

FIGS. 30 to 32 are simulated isolation diagrams of three non-planar antennas, i.e., a GPS antenna, SDARS antenna, and ETC antenna.

Figure 33:
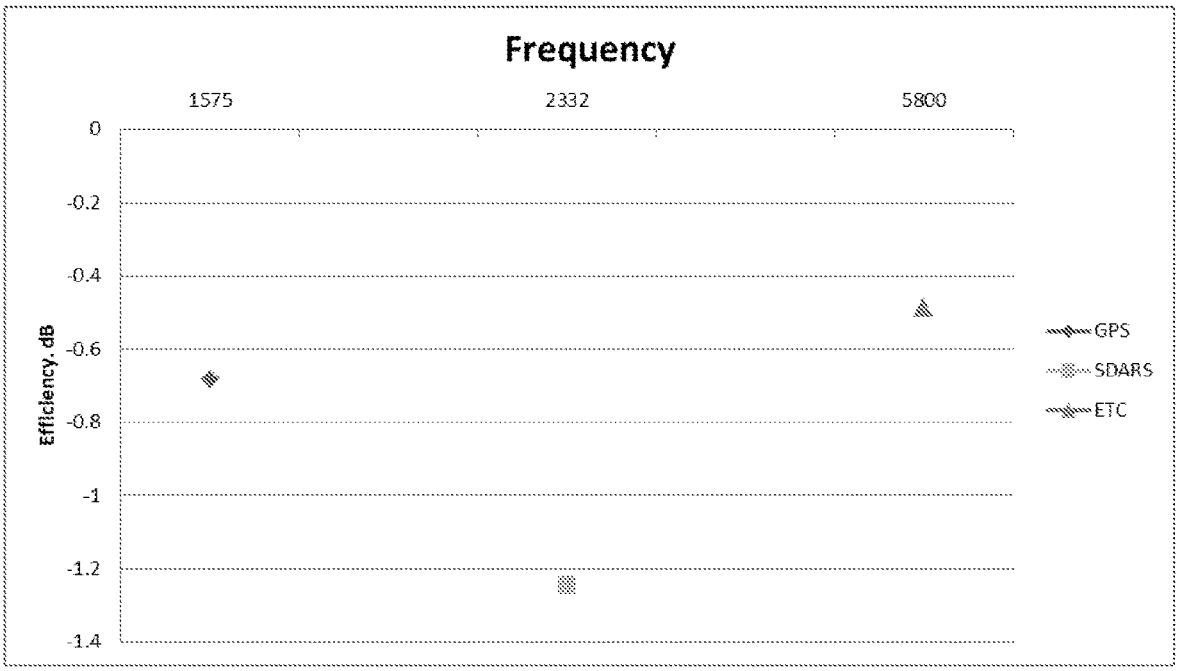
FIG. 33 shows a simulated efficiency diagram of a GPS antenna, SDARS antenna, and ETC antenna in a highly integrated vehicle antenna configuration according to Embodiment 2 of the present disclosure.

FIG. 33 is a simulated efficiency diagram of three non-planar antennas, i.e., a GPS antenna, SDARS antenna, and ETC antenna. It is easy to see from the simulated results that the isolation between the three non-planar antennas and the four planar antennas is better than −15 dB, and the antenna performance meets the working requirements.

Embodiment 3

Figure 34:
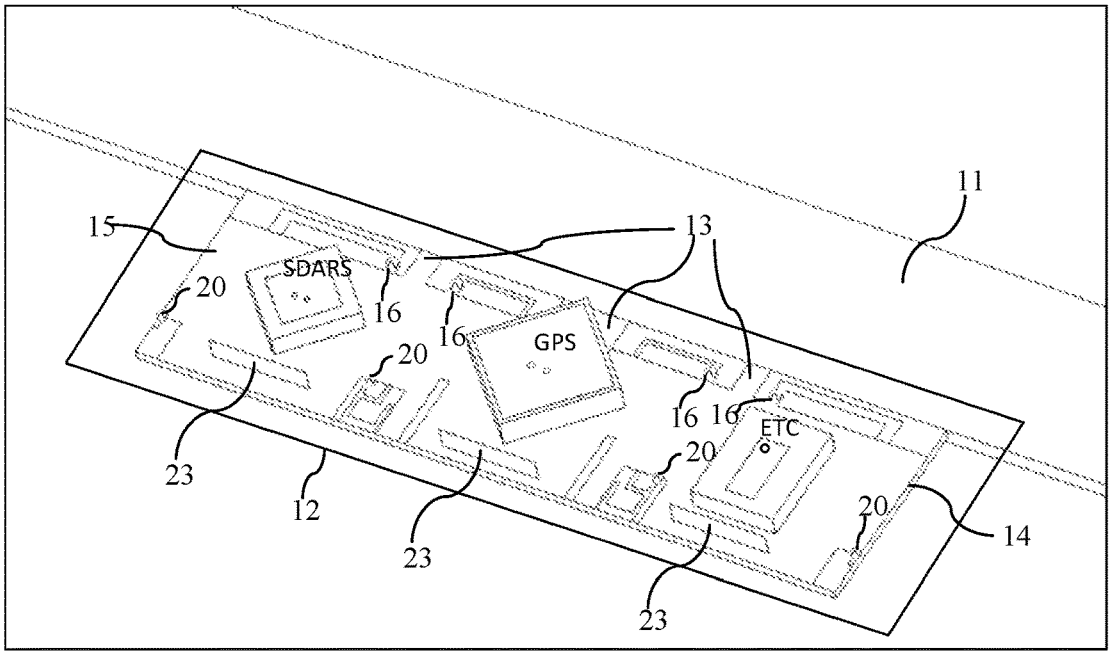
FIG. 34 is a schematic diagram showing the structure of a highly integrated vehicle antenna configuration according to Embodiment 3 of the present disclosure.
Figure 35:
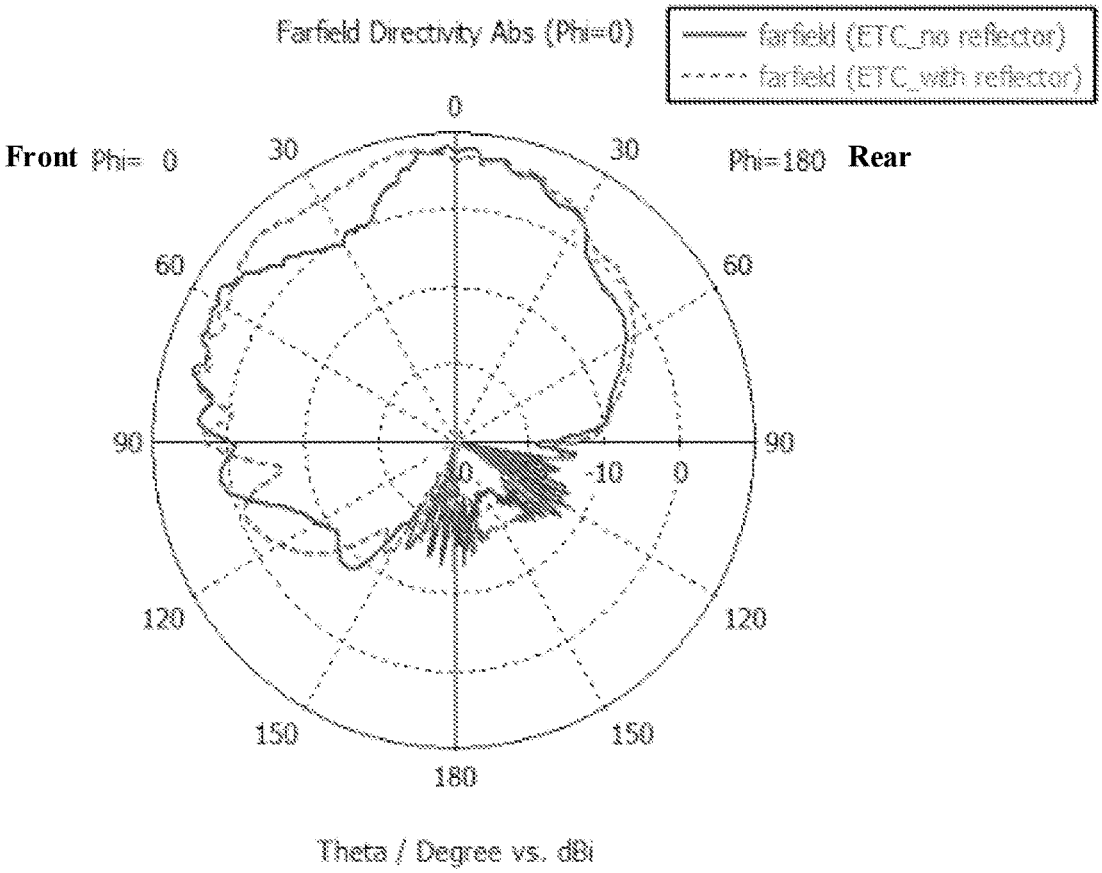
FIG. 35 shows a comparison diagram of the radiation directions of an ETC antenna in a highly integrated vehicle antenna configuration of the third embodiment of the present disclosure.
Figure 36:
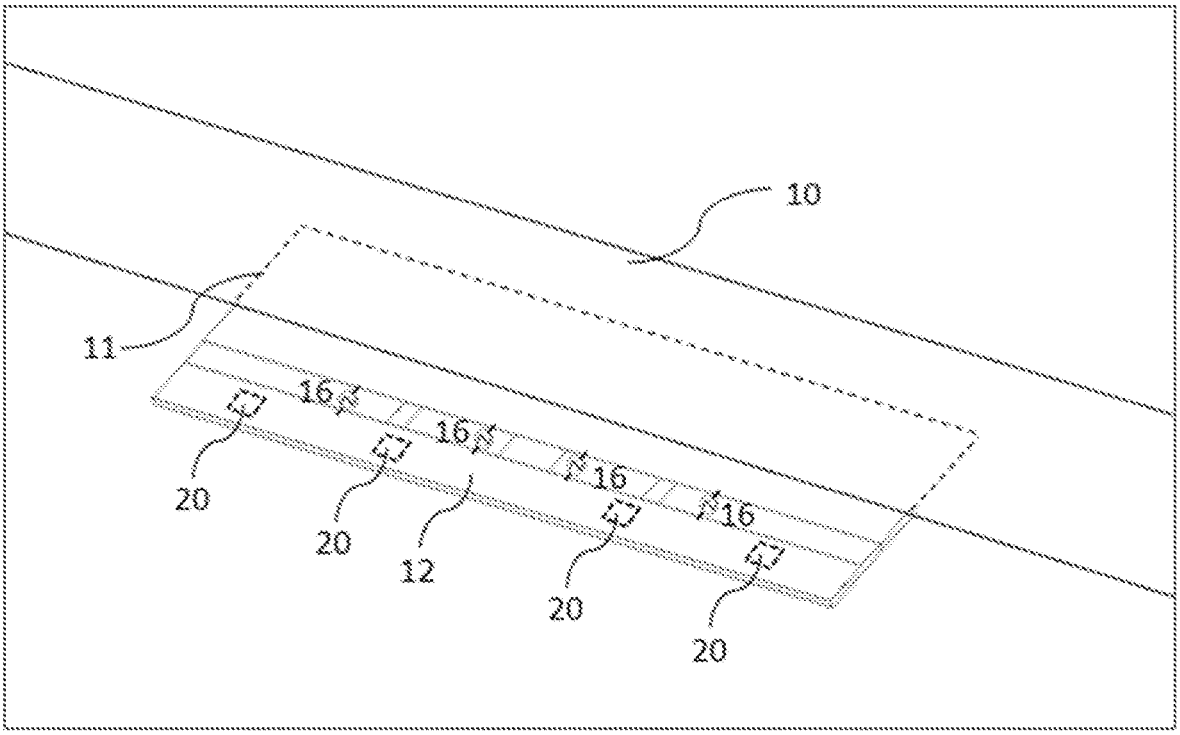
FIG. 36 shows a highly integrated vehicle antenna configuration of the present disclosure, and its metal structure is a metal plate.

As shown in FIG. 34, the highly integrated vehicle antenna configuration shown in this embodiment is basically the same as Embodiment 2, except that this embodiment additionally includes adjusting reflectors 23 on the basis of Embodiment 2, and the adjusting reflector 23 is made of metal. The adjusting reflectors 23 are respectively set on one side of the antenna radiator of the SDARS antenna, GPS antenna and ETC antenna, and an orthographic projection of each antenna radiator onto the plane containing a surface of a corresponding reflector 23 at least partially overlaps with the surface of the corresponding adjusting reflector 23. By optimizing the position and height of the adjustment reflectors 23, the corresponding antenna radiation directivity can be adjusted. As shown in FIG. 35, after the adjusting reflector 23 is added to the ETC antenna, the radiation recess in the +0°~+90° direction is significantly improved.

Embodiment 4

Figure 42:
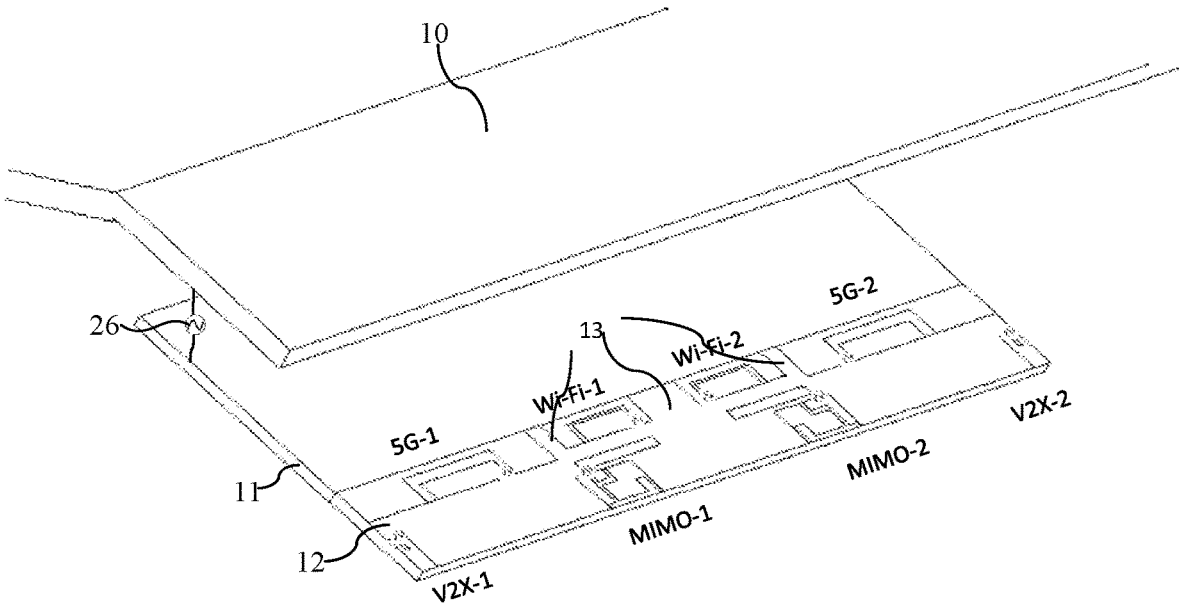
FIG. 42 is a cross-sectional view of a highly integrated vehicle antenna configuration according to Embodiment 4 of the present disclosure.
Figure 43:
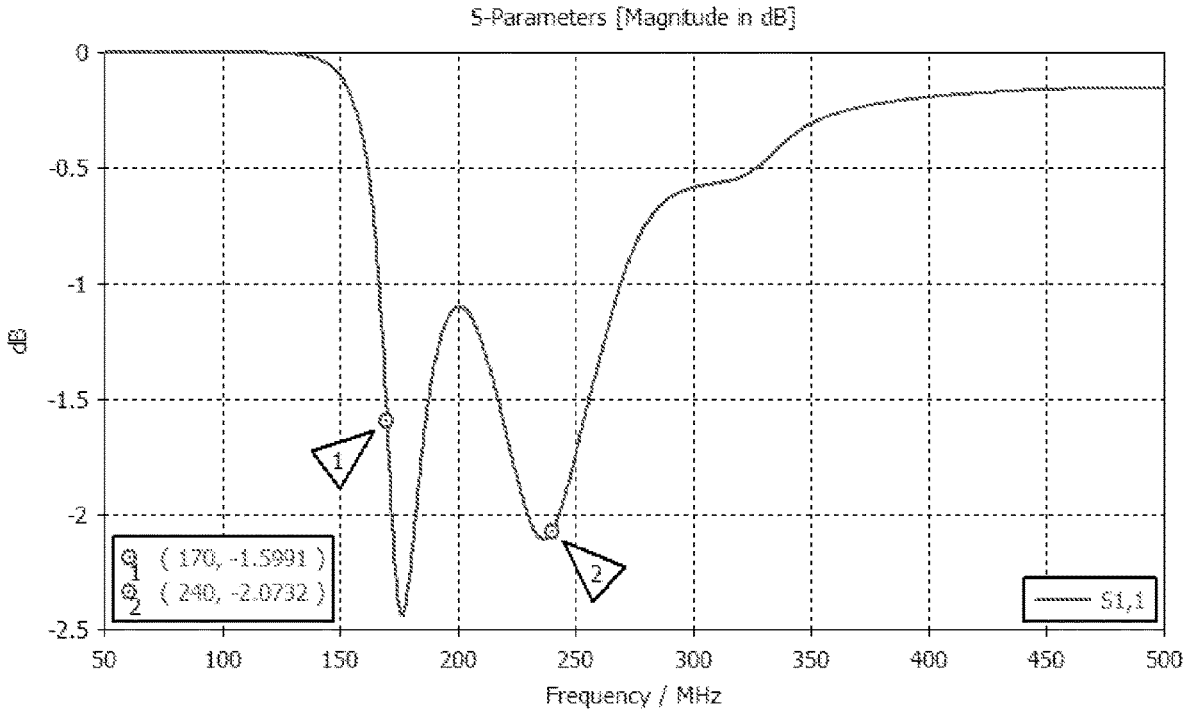
FIG. 43 shows a simulated return loss diagram of a DAB antenna in a highly integrated vehicle antenna configuration according to Embodiment 4 of the present disclosure.
Figure 44:
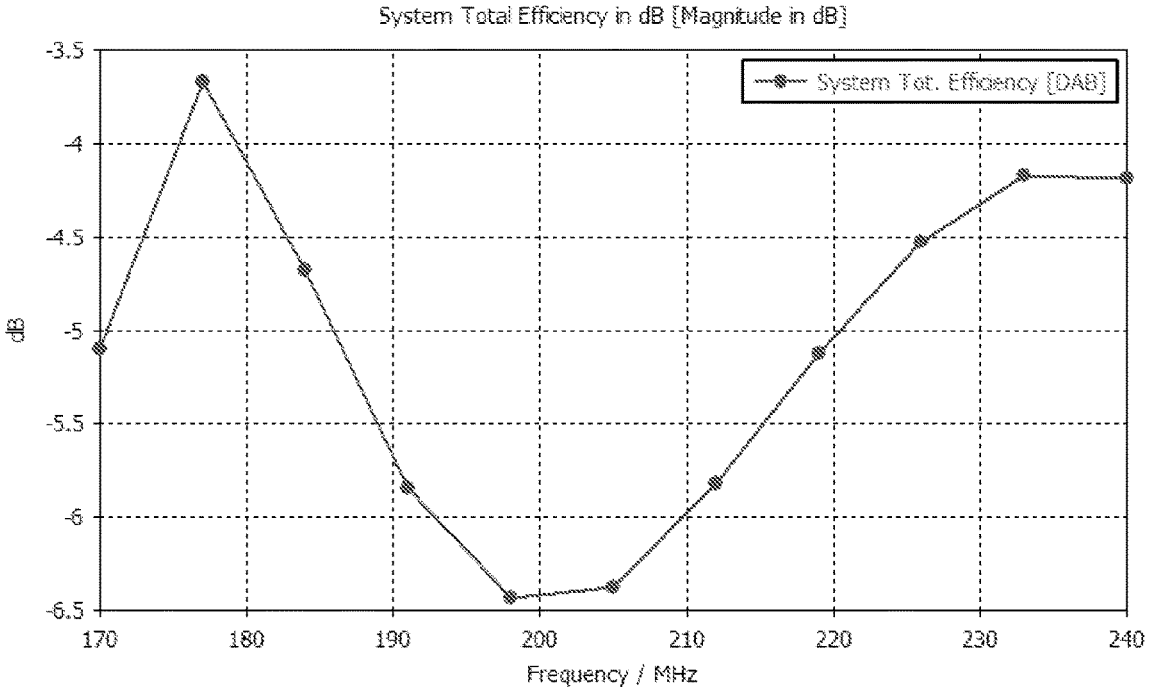
FIG. 44 shows a simulated efficiency diagram of a DAB antenna in a highly integrated vehicle antenna configuration according to Embodiment 4 of the present disclosure.
Figure 45:
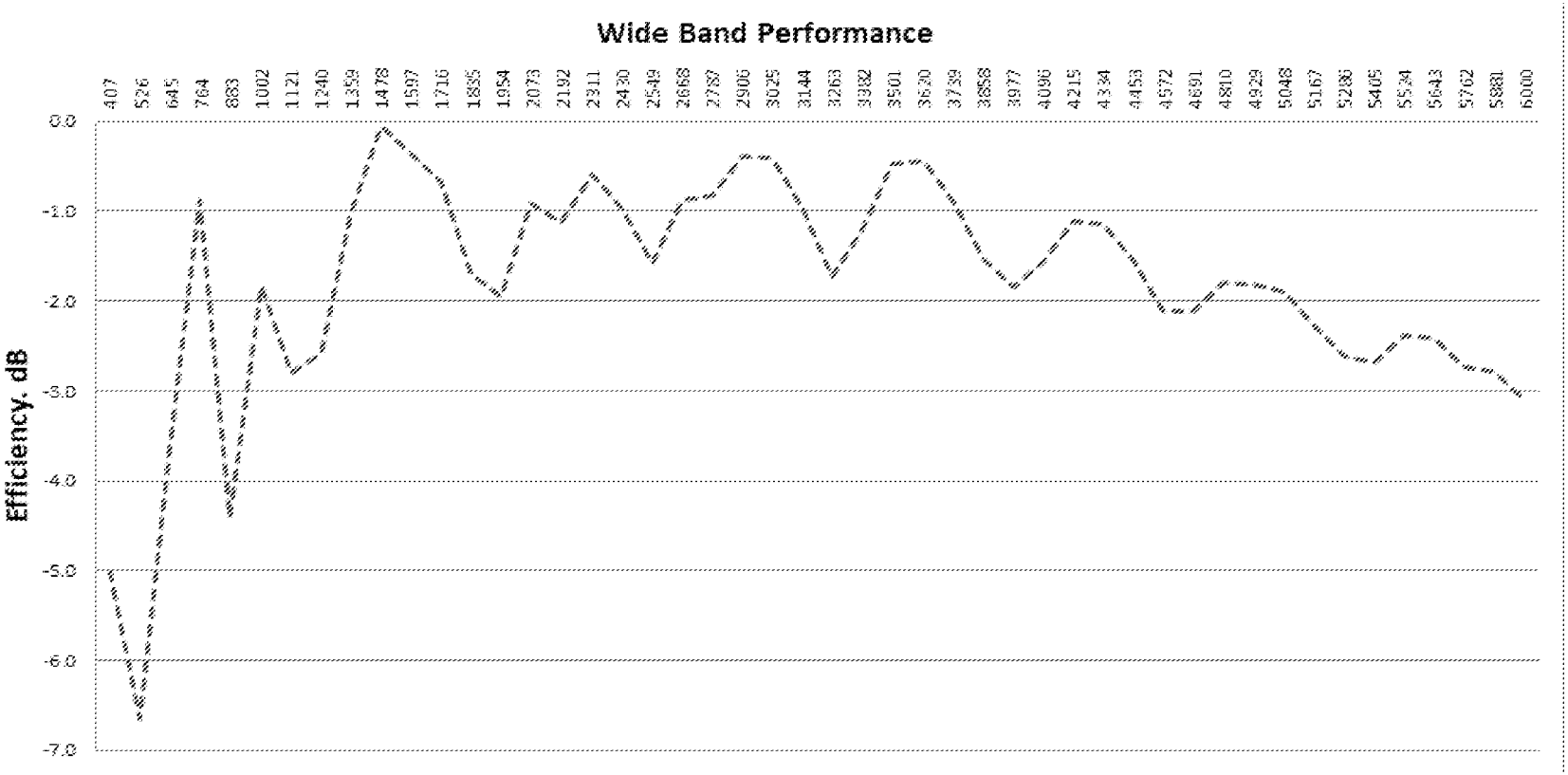
FIG. 45 shows a radiation simulated efficiency diagram of the highly integrated vehicle antenna configuration according to Embodiment 4 of the present disclosure, under the excitation of a second excitation signal source without an antenna matching network.

As shown in FIG. 42, the antenna structure and layout of this embodiment are the same as those of Embodiment 1. The dimensions of the broadband antenna 12 are 200 mm*20 mm*2 mm, the metal structure 11 is a metal plate, and the number of the first electrical connection structures 13 is 3. The antenna module 17 includes four planar antennas. For more details, please refer to Embodiment 1. Two 5G antennas 5G-1, 5G-2, with working frequency bands of 600 MHz-6000 MHz, are constructed through the broadband antenna 12 and metal plate 11; there are also two dual-band (2.4 GHz and 5 GHz) Wi-Fi antennas Wi-Fi-1, Wi-Fi-2, two MIMO antennas MIMO-1, MIMO-2, with working frequency bands of 1700 MHz-6000 MHz, and two V2X antennas V2X-1, V2X-2, with working frequency bands of 5905 MHz-5925 MHz. Embodiment 4 is also different from Embodiment 1 in that the second excitation signal source 26 in Embodiment 4 is loaded between the metal frame of the vehicle 10 and the metal plate 11 to form a single antenna form with a single feed point. The second excitation signal source 26 is a DAB signal source, and the design of a DAB antenna is realized through optimization of a matching circuit, and its working frequency band covers 170 MHz to 240 MHz. FIG. 43 is a simulated return loss diagram of the DAB antenna, and FIG. 44 is a simulated efficiency diagram of the DAB antenna. It can be seen that the performance of the DAB antenna meets the working requirements. FIG. 45 shows the antenna radiation performance when the matching circuit is not connected. From FIG. 45, it can be seen that the resonance excited by the second excitation signal source 26 has good radiation performance in the frequency band of 400 MHz to 6000 MHz. Therefore, the second excitation signal source 26 can be used in antennas of various types, such as FM, RKE, DAB, DTV, 2G, 3G, 4G, 5G (FR1), Wi-Fi, UWB etc.

In summary, the highly integrated vehicle antenna configuration of the present disclosure can realize multiple broadband antennas through the same spatial location of the broadband antenna, and construct other antennas on the broadband antenna at the same time, and ensure the original broadband antenna. The broadband antenna performance can also maintain good isolation between all antennas, thereby effectively improving the integration of the vehicle antenna configuration, reducing the complexity and cost of the vehicle antenna system, and being easy to implement. Therefore, the present disclosure effectively overcomes various shortcomings in the prior art and has a high industrial value.

The foregoing embodiments only exemplarily illustrate the principle and effects of the present disclosure, and are not used to limit the present disclosure. Anyone familiar with this technology can modify or change the above-mentioned embodiments without departing from the spirit and scope of the present disclosure. Therefore, all equivalent modifications or changes made by those with ordinary skills in the technical field without departing from the spirit and technical concepts disclosed in the present disclosure should still be covered by the attached claims of the present disclosure.

What is claimed is:

1. An integrated vehicle antenna configuration, which is arranged in at least one position inside a vehicle, comprising:

a metal structure, which serves as a reference ground for a broadband antenna;

the broadband antenna, which includes a dielectric layer and a metal layer disposed on the dielectric layer, wherein the metal layer has a continuous structure or a discontinuous structure;

at least one first electrical connection structure, wherein one end of each of the at least one first electrical connection structure is electrically connected to the metal structure, and the other end is electrically connected to the metal layer of the broadband antenna;

at least two first excitation signal sources, loaded between the metal structure and the metal layer of the broadband antenna, wherein the at least two first excitation signal source excites resonant modes of the metal structure and the broadband antenna, to achieve a broadband design; and at least two antenna modules, located on the broadband antenna, wherein the metal layer of the broadband antenna serves as an antenna radiator and/or a reference ground of the at least two antenna modules.

2. The integrated vehicle antenna configuration according to claim 1, wherein the at least one first electrical connection structure is an outer conductor of a communication signal line and/or a metal layer wrapped around the communication signal line.

3. The integrated vehicle antenna configuration according to claim 1, wherein the broadband antenna and/or the at least two antenna modules are fed through a transmission line, and a reference ground of the transmission line has a function of the at least one first electrical connection structure.

4. The integrated vehicle antenna configuration according to claim 1, wherein the at least two first excitation signal sources adopt a ring excitation mode or a coupled excitation mode.

5. The integrated vehicle antenna configuration according to claim 1, wherein the at least two antenna modules includes one or more planar antennas and/or one or more non-planar antennas.

6. The integrated vehicle antenna configuration according to claim 5, wherein when the at least two antenna modules include one or more planar antennas, the one or more planar antennas are distributed along a long side of the broadband antenna away from the metal structure, wherein when the at least two antenna modules include one or more non-planar antennas, the one or more non-planar antennas are distributed along the long side of the broadband antenna away from the metal structure, or distributed along the broadband antenna and a line segment connecting the non-planar antennas substantially bisects the narrow side of the broadband antenna.

7. The integrated vehicle antenna configuration according to claim 6, wherein the one or more non-planar antennas include one or more of a SDARS antenna, GPS antenna, and ETC antenna, wherein the one or more of a SDARS antenna, GPS antenna, and ETC antenna are distributed along a longitudinal direction of the broadband antenna and the line segment connecting the one or more non-planar antennas substantially bisects the narrow side of the broadband antenna.

8. The integrated vehicle antenna configuration according to claim 7, wherein the one or more of a SDARS antenna, GPS antenna, and ETC antenna are provided with an adjusting reflector and the adjusting reflector is used to adjust a directivity of its corresponding antenna.

9. The integrated vehicle antenna configuration of claim 6, wherein the one or more non-planar antennas comprise at least one of a MIMO non-planar antenna and V2X non-planar antenna, and the at least one of a MIMO non-planar antenna and V2X non-planar antenna are distributed along the broadband antenna and away from a long side of the metal structure.

10. The integrated vehicle antenna configuration according to claim 1, wherein the metal layer of the broadband antenna is provided with a slot, and the slot is used to increase an isolation between the at least two antenna modules, and an isolation between the at least two antenna modules and the at least two first excitation signal sources.

11. The integrated vehicle antenna configuration of claim 1, wherein the broadband antenna is a circuit board of a multimedia system/telematics control unit of the vehicle.

12. The integrated vehicle antenna configuration according to claim 1, wherein the metal structure is a metal frame of the vehicle.

13. The integrated vehicle antenna configuration according to claim 1, wherein the metal structure is a metal plate.

14. The integrated vehicle antenna configuration according to claim 13, wherein one or more second electrical connection structures are provided between the metal plate and a metal frame of the vehicle, and one end of each of the one or more second electrical connection structures is electrically connected to the metal plate, and the other end is electrically connected to the metal frame, wherein an orthographic projection of the metal plate onto a plane containing a surface of the metal frame closest to the metal plate at least partially overlaps the surface of the metal frame.

15. The integrated vehicle antenna configuration according to claim 13, further comprising at least one second excitation signal source loaded between the metal plate and a metal frame of the vehicle, wherein the at least one second excitation excites resonance modes of the metal plate and the metal frame to excite resonances with a selected frequency range between 80 MHz and 10000 MHz.

16. The integrated vehicle antenna configuration of claim 15, wherein the at least one second excitation signal source adopts a direct excitation mode or a coupled excitation mode.

* * * * *